US010271627B1

(12) United States Patent
Calvo

(10) Patent No.: US 10,271,627 B1
(45) Date of Patent: Apr. 30, 2019

(54) DEVICE, SYSTEM AND METHOD FOR STORING, PROCESSING AND DISPENSING HAIR BUILDING MATERIAL

(71) Applicant: Joseph J. Calvo, Miami, FL (US)

(72) Inventor: Joseph J. Calvo, Miami, FL (US)

( * ) Notice: Subject to any disclaimer, the term of this patent is extended or adjusted under 35 U.S.C. 154(b) by 648 days.

(21) Appl. No.: 14/585,563

(22) Filed: Dec. 30, 2014

Related U.S. Application Data

(60) Provisional application No. 61/936,001, filed on Feb. 5, 2014.

(51) Int. Cl.
*A46B 11/00* (2006.01)
*A45D 24/22* (2006.01)
*A45D 19/02* (2006.01)

(52) U.S. Cl.
CPC ..... *A45D 24/22* (2013.01); *A45D 19/02* (2013.01); *A46B 11/001* (2013.01); *A45D 2019/025* (2013.01)

(58) Field of Classification Search
CPC ..... A45D 19/02; A45D 24/24; A45D 24/26; A45D 24/28; A45D 2019/0066; A45D 24/22; A45D 2200/207; A46B 11/001; A46B 11/0013; A46B 11/0062; A46B 11/0065; A46B 11/0075; A46B 2200/10; A46B 2200/102; A46B 2200/104; A46B 2200/1046
USPC ..... 132/114, 112, 113, 115, 116; 119/602, 119/603
See application file for complete search history.

(56) References Cited

U.S. PATENT DOCUMENTS

| | | | | | |
|---|---|---|---|---|---|
| 1,594,636 | A | | 8/1926 | Smith | |
| 2,383,967 | A | * | 9/1945 | Hernon | A45D 24/16 132/102 |
| 2,737,190 | A | * | 3/1956 | Magnusson | A45D 24/24 132/114 |
| 2,819,723 | A | * | 1/1958 | Meyer | A45D 24/22 132/116 |
| RE25,585 | E | | 5/1964 | Birch et al. | |
| 3,960,160 | A | | 6/1976 | Hogan | |
| 4,121,602 | A | * | 10/1978 | Young | A45D 24/22 132/113 |
| 4,792,250 | A | * | 12/1988 | Turner | A45D 19/00 132/112 |
| 5,054,504 | A | | 10/1991 | Winrow | |
| 5,076,298 | A | * | 12/1991 | Busch | A45D 19/02 132/108 |

(Continued)

FOREIGN PATENT DOCUMENTS

KR 20060127914 * 10/2017

*Primary Examiner* — Tatiana Nobrega
*Assistant Examiner* — Brianne Kalach
(74) *Attorney, Agent, or Firm* — Malloy & Malloy, P.L.

(57) ABSTRACT

A device, system and method for treating the scalp hair of an individual including the storing, processing, and dispensing hair building material, wherein the device includes at one or more housings connected to a base and a plurality of bristle elements disposed in a flow receiving relation to hair building material contained within the different housings of the base. A vibratory force is exerted on the base, housings and/or hair building material contained therein to facilitate a con current dispensing of different portions of the hair building material in a manner which accomplishes and at least partial blending of the different portions of the hair building material in the area of a bristle portion of the base. Once blended the hair building material is distributed throughout intended portions of the hair of a user by the bristles.

16 Claims, 12 Drawing Sheets

(56) References Cited

U.S. PATENT DOCUMENTS 5,119,838 A * 6/1992 Nakazima ..... A45D 19/02 132/108
5,622,192 A * 4/1997 Chiou ..... A46B 11/0058 132/112
5,762,433 A 6/1998 Cary
5,927,290 A * 7/1999 Thiruppathi ..... A46B 11/0017 132/116
6,877,924 B1 * 4/2005 Mears ..... A45D 19/02 132/114
6,962,158 B1 11/2005 Anguelo
7,261,108 B2 8/2007 Dallianis et al.
7,322,363 B1 1/2008 Dillard
7,465,114 B2 * 12/2008 Kress ..... A45D 40/262 15/22.1
7,814,917 B2 10/2010 Hurwitz
8,347,894 B1 * 1/2013 Stewart ..... A45D 24/28 132/114
8,777,132 B2 7/2014 Isaacs
2008/0202544 A1 * 8/2008 Hurwitz ..... A01K 13/002 132/114
2009/0101159 A1 * 4/2009 Bonnafous ..... A45D 19/02 132/112
2010/0186762 A1 * 7/2010 Spagnuolo ..... A45D 19/0008 132/115
2011/0293680 A1 12/2011 Jo et al.
2013/0048003 A1 * 2/2013 Antons ..... A45D 24/28 132/116
2013/0115183 A1 * 5/2013 Ko ..... A61Q 5/006 424/70.11
2015/0059798 A1 * 3/2015 Mazed ..... A45D 20/50 132/272

* cited by examiner

FIG. 3
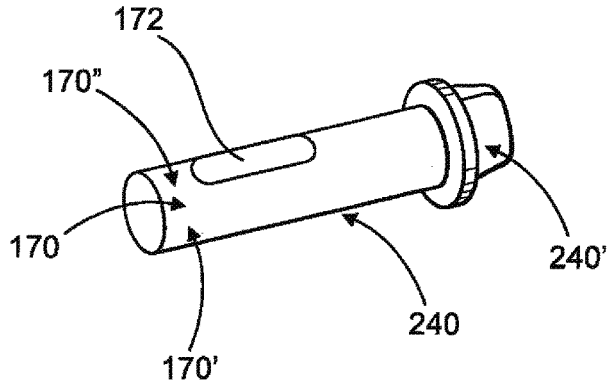
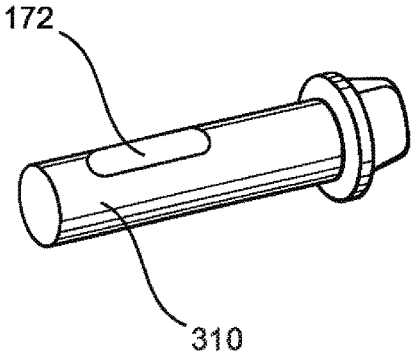
FIG. 3A
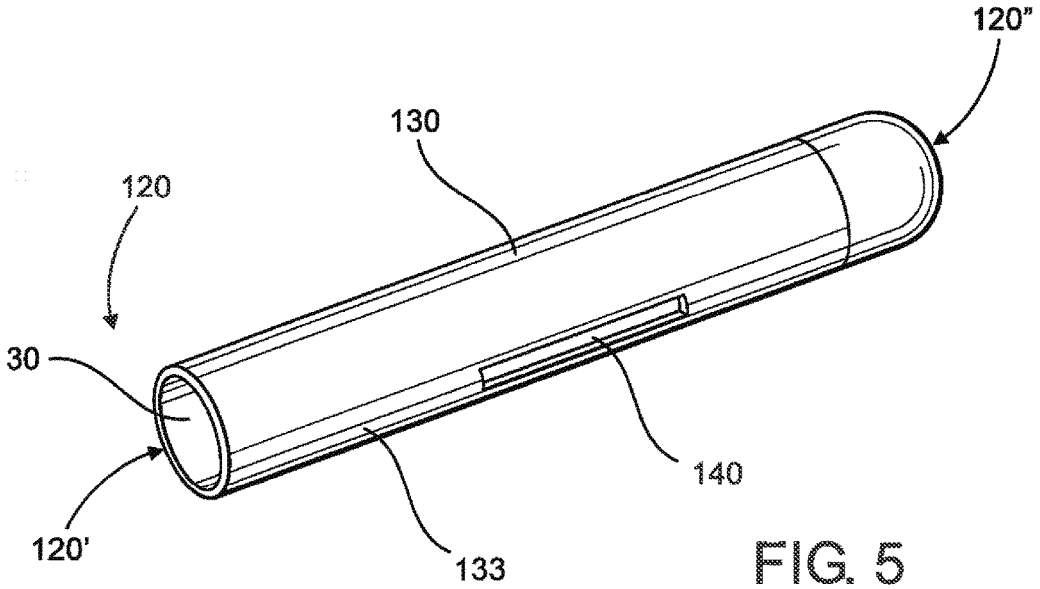
FIG. 5

DEVICE, SYSTEM AND METHOD FOR STORING, PROCESSING AND DISPENSING HAIR BUILDING MATERIAL

CLAIM OF PRIORITY

The present application is based on and a claim of priority is made under 35 U.S.C. Section 119(e) to a provisional patent application that is in the U.S. Patent and Trademark Office, namely, that having Ser. No. 61/936,001 and a filing date of Feb. 5, 2014, and which is incorporated herein by reference.

BACKGROUND OF THE INVENTION

Field of the Invention

The present invention is directed to a new and improved device for storing, processing, and dispensing hair building material.

Description of the Related Art

Alopecia is a medical term used when referring to a condition of thinning hair, partial hair loss or complete hair loss. In effect, nearly any form of hair loss can be considered as alopecia. With several contributing factors for hair loss and limited research available, comprehending hair loss can be intimidating to many. Equally daunting, is finding solutions readily available for hair loss treatment. Certainly, hair loss is more common in men, albeit many women also suffer from various forms of alopecia. Alopecia in men and women, however, can vastly differ in areas of baldness or thinning as evidenced by certain patterns. In other words, female pattern baldness and men pattern baldness can differ based on condition and configuration of baldness. More specifically, the reason behind areas of thinning or balding in both men and women can vastly differ based on conditions related to genetic disposition or medical abnormalities. Of course, in both men and women, however, each strand of hair is retained in a cavity of the skin called a follicle. Hair loss occurs when the follicle miniaturizes over time. This means that the follicle prohibits further hair growth causing the affected strand of hair to result in being shorter and finer than normal. Consequently over time, the follicle inhibits further new hair growth, causing the hair strand to eventually fall out of the follicle, and perish indefinitely. As such, with no new hair growth in the follicle, and collectively more strands of hair thinning and falling out of affected follicles, a resulting pattern of baldness is evidenced over a period of time.

For this and other reasons, there are a few non-surgical and surgical solutions available in the market. These solutions strive to help reduce hair loss or the miniaturization of the hair follicles. However, many of them only tend to work in only a certain percentage of men and women. This leaves a vast sample of hair loss sufferers without help. For instance, some of the known non-surgical solutions include, but are not limited to, topical solutions and consumable drugs. Both of these recognized options, however, do not indiscriminately provide results to everyone. To illustrate this more specifically, most topical solution products that contain Minoxidil, a known ingredient to reduce hair loss and in some cases regrow hair, require a strict regimen of application to the affected area. This essentially means that any lag, inconsistency or discontinuation in application to the affected area will more than likely result in major setback. This may include losing some or most of the regrown hair and/or continued loss of existing hair. Furthermore, this loss of hair can occur within a short amount of time, despite months of consistent use by the user. Additionally, Minoxidil also has many adverse effects to humans and their pets. For example, Minoxidil can be highly toxic to some domestic pets, causing death advertently with mere skin contact with the animal. In humans, Minoxidil contains side effects including burning, irritation of scalp or eye, itching, redness as well as risk of unwanted hair elsewhere on the person's body other than the treated area. Side effects can also be serious in some cases. Allergic reactions, rashes, hives, tightness in respiration, swelling of the mouth, dizziness and even tachycardia are just to name a few. Other ingredients besides Minoxidil in many topical solutions such as alcohol or propylene glycol can also present their own issues. Dryness of the scalp resulting in embarrassing dermatitis and dandruff is one of them.

Similarly, consumable drugs that are taken orally require the following of strict routine. First, effective consumable drugs to treat hair loss require a prescription by a medical practitioner. This means that the hair loss sufferer cannot merely go to a local pharmacy and get the consumable drugs over the counter. It requires an expensive visit to the medical practitioner. Next, any delay or discontinuation in daily usage can result in the reverse; reduction of hair loss can quickly follow within 30 to 60 days. Additionally, some of the consumable drugs taken orally are prone to harmful side effects. For instance, Finasteride, an active ingredient in most of the orally consumed drugs in hair loss prevention has been proven to significantly decrease testosterone levels in some men, who have regularly taken them. Moreover, what is alarming is that the drop in testosterone level in these cases, can last at an average of 40 months, sometimes even after the user has discontinued their use. This can be a devastating experience for men, who are not only losing hair, but are now also suffering from unwarranted side effects of low testosterone. Accordingly, many of the side effects due to consumable drugs for hair loss prevention seem to be more cumbersome than the problem of losing hair itself.

As another drawback often associated with consumable drugs taken orally is that they must be taken regularly often for an average of 18 months before the user taking them regularly can see desired results. Furthermore, in some cases, the user may not see any results at all. In other words, the consumable drugs do not guarantee hair regrowth or hair loss prevention for everyone. This means that the user may regularly use the drugs, yet not experience any benefits of reduction in hair loss. As a result, the person could have possibly spent hundreds, if not thousands of dollars on these consumable drugs, only to realize that the results are not guaranteed.

Comparatively, there are other alternatives to treat hair loss. These include surgical solutions, where the person experiences minimally invasive surgery to treat hair loss. More specifically, the minimally invasive procedure may require transplanting each strand of hair from a donation area, where the hair growth is dominant to a treatment area, where the hair loss is evident. The surgical solutions, in most cases, however, are expensive and generally not covered by insurance companies. For example, the average cost of a hair transplant by minimally invasive surgery can range anywhere from $7,000 to $15,000 or even more. These numbers can be even higher depending on the locality, experience and skill set of the surgeon. Furthermore, many insurance companies do not cover such type of cosmetic surgeries. More often than not, the person has to pay the expenses of a hair transplant surgery from personal funds.

Meanwhile, the minimally invasive surgeries to treat hair loss are also time consuming. They require a lot of time and commitment on the part of the patient. For instance, hair transplant surgeries can last for hours based on the fact that each strand of hair has to be taken from the donation area and replaced in the affected area. The hair transplant surgery also requires a lot of follow-up time. For example, patients of hair transplant surgeries are succumbed to several time consuming follow-up visits with the surgeon, sometimes even months after the surgery has been completed. Many surgeons also require their hair transplant patients to follow-up regularly due to the possible inconsistency in the growth of follicles, given that new hair was transplanted only in some follicles. Furthermore, most of the surgical procedures are not aesthetically pleasing. For example, surgical procedures can leave an unpleasant scar on the person head, usually in the donation area, where the surgeon has removed the scalp and hair. This means, that the person has to leave their hair at a particular length, so that the scar can remain hidden from public eye.

Moreover, as in other solutions, there are no guarantees in hair transplant surgeries. For instance, a hair loss patient with a larger balding area and smaller donating area from where hair will be transplanted may not yield to a favorable aesthetic gratification as someone who may have a smaller balding area and larger donating area resulting in a fuller hair look. Therefore, in certain procedures, the hair loss solution due to a transplant may appear to be even worse than the original condition.

Another known viable alternative to treat hair loss is wearing a hair wig or toupee. These too, however, have detrimental results. For wearers, there is a constant fear of discovery, as it can be difficult to admit that they are wearing a wig or toupee. Furthermore, despite the quality of wigs ranging from synthetic to human hair, there is no guarantee that wigs or toupees will go completely undetected by the probing eyes of the public. Correspondingly, quality hair wigs or toupees made of real human hair are highly expensive and hard to find. An average cost of a human hair wig can be hundreds, if not thousands of dollars. Additionally, hair wigs and toupees also require a great detail of maintenance. Wearing a wig or toupee tends to call for constant upkeep and can be a time absorbing ordeal that requires frequent retightening, washing, brushing and cleaning. Moreover, because some wigs or toupees require a vacuum fit on the hair scalp to prevent bacteria, and a non-vacuum environment can breed bacteria on the exfoliated skin, increasing excess sebum and causing undesirable odor on the scalp. Clearly, there is an exorbitant amount of commitment and expense required in both the known non-surgical and surgical methods currently in the market, without any guarantee of satisfactory results.

Fortunately, technology has improved and thinning hair or hair loss is no longer a niche market confined only to the surgical and non-surgical solutions aforementioned. This is helpful because given the growing public use and acceptance of various social media, hair loss sufferers are ever more cognizant of their appearance and condition. Accordingly, the cosmetic industry directed to hair loss is no longer focusing only on topical solutions, drugs taken orally or surgical transplants as viable alternatives, and as a result, some new hair loss solutions are now becoming available. Amidst this, and for reasons already noted herein, hair loss victims are demanding a solution that requires little commitment, low cost and negligible distress. Furthermore, there is a demand that the solution be elegant and aesthetically appealing, without yielding an artificial look, especially as many hair loss sufferers are already conscious about their existing hair loss condition. Additionally, many hair loss sufferers are seeking solutions that are free from harmful side effects, which do not cost a lot of money or require an inordinate amount of time to yield results, and that do not prohibit aesthetic pleasure.

One technology that has gained notoriety in the cosmetic industry for hair loss prevention is providing hair loss victims with hair building fibers or material. Treating hair loss with hair building fibers is increasingly becoming a preferred method of concealing hair loss because of the relatively small time commitment involved. For instance, hair building fibers can be applied once daily, and can be easily washed off. Hair building fibers also do not require much time during application. They can be applied anytime of the day or night with little to no effort and care. Furthermore, hair building fibers easily blend in with the person's natural hair producing an authentic and fuller look. The pricing of hair building fibers also make them appealing. For instance, hair building fibers are relatively cheap compared to other expensive non-surgical and surgical solutions. Altogether, they are designed to conceal hair loss for people with various forms of baldness patterns, including both men and women. They come in different shades, colors and textures. They also blend in with the user's natural hair and almost seamlessly give a much sought after fuller, natural look. Hair building fibers are also proven to be highly durable. This is primarily due to the technology and ingredients involved. For instance, hair building fibers can be worn all day, and often even for several days, depending on the rigor and format of activities engaged by the user. All things considered, the key to the durable characteristics of hair building fibers is that they bind to the hair with an electrostatic charge created by a hair applicator, often by electrical and mechanical means. It would be ideal, however, if there were a device capable of storing and processing certain components or ingredients used as hair building materials in separate chambers, and which could also combine these hair building materials in an advantageous way upon the device's being picked up and used by a person, so that as the person dispenses the hair building materials, including the right ingredients, these materials are applied to the person's hair both evenly and in as natural a way as possible, and so as to be long lasting, while offering the user an appearance similar to or equally as good as those devices that rely on an electrostatic charge. That is to say, there is a need in the market for a hair applicator that can store and dispense hair building materials containing the right ingredients, and that can effectively be used by anyone suffering from hair loss to achieve a satisfying result in appearance that is also relatively long lasting in terms of daily use.

SUMMARY OF THE INVENTION

The invention is intended to present a solution to these and other needs which remain in the relevant field of art. As such, and for purposes of clarity in describing the structural and operative features in at least one preferred embodiment, the present invention is directed to a device, which can also be referred to as a Processor Dispensing Unit, that allows a user to store, process and dispense hair building material. In this regard, the device can store, process, and dispense a hair building material or a combination of hair building materials. This can include but is not limited to the dispensing of hair-like strands, and also coloring material(s) if desired, onto a user's hair and/or scalp area, in an amount sufficient to result in a smooth, natural-looking blend with the natural hair. More specifically, the hair applicator device of the present invention is structured to separately store and process hair building material, including but not limited to a combination of a liquid and/or gel like composition on the one hand, and one or more dry powders on the other, and then to dispense the blended hair building materials directly onto to the hair and/or scalp of the user. This can be accomplished with little effort, all the while the user is brushing his or her hair with the inventive device. In this regard, the device can be utilized on a variety of different hair types, textures and colors, and in combination with a variety of hair building ingredients.

As will be described in greater detail herein, the device of the present invention comprises a central housing that is generally constructed of a rigid material. The central housing has a hollow interior first chamber and is connected to a base. Additionally, the central housing of the device is sized, structured and configured to receive, within its hollow interior first chamber, a cartridge or a cartridge assembly containing hair building material. As will be explained in greater detail herein, the cartridge assembly may comprise of a first cartridge assembly and a second cartridge assembly. Furthermore, in one embodiment, the base, to which the central housing is connected, is structured to have at least one actuator, which can be configured to have at least one power switch or take off. Additionally, the base can be made of a generally rigid material and configured to function as a handle, helping the user to effectively grasp and/or grip the device of the present invention as needed or required. It can also include a motor and a plurality of gears fitted inside the interior portion or portions thereof. The motor and the plurality of gears are operably connected to the power supply source. The power supply source is also preferably disposed within the interior portion of the base. Additionally, the power supply source can generally function on a low power voltage, preferably with the use of a battery as its primary power source. In contrast, the device can also be operable with other forms of power supply sources, including but not limited to electric power supplies. Alternatively, the device can also function manually, requiring no power source. The base can be sealed to prevent its interior portion from any potential water damage or other user related damages.

Furthermore, it is preferred that the central housing of the device has an open end and a second, oppositely disposed closed end that is connected to the base. In an alternative preferred embodiment, however, the central housing is structured to be removably attached to the base. More specifically, the present invention allows a user to selectively detach the central housing from the base due to the structuring of the second closed end thereof. This selective detachment and re-attachment of the housing to and from the base will be further explained in greater detail below, including the many advantages it offers of allowing the user to carry a portable device for dispensing hair building material(s) as needed while he/she is on the go.

In addition to this, the central housing also has an exterior surface with a plurality of bristle elements attached thereto. The plurality of bristle elements can be detachable or permanently affixed to the exterior surface of the central housing. More specifically, the hair applicator device of the present invention can, in some embodiments, be configured to allow the plurality of bristle elements to be completely detached from the base so as to allow the user to use the device as a pocket portable for "on the go" spot treatment of the hair. To illustrate this, the plurality of bristle elements can be detached from the base to store the device in a portable manner, allowing the user to spot treat the affected areas as and when needed. Additionally, the plurality of bristle elements can also be interchangeable. This allows the user to use various types of bristle elements, depending on the texture or style of the user's hair. Furthermore, each of the plurality of bristle elements can have a ball tip on each of their respective ends. As such, the ball tips of the plurality of bristles can be structured to create a mechanical friction on the user's hair scalp due to their movement by vibration in the embodiment wherein the hair applicator device includes a motor, and also by the user's manual movement of the bristles across his or her hair and scalp. This mechanical friction contributes to the smooth attachment of the hair building material onto the user's scalp and with greater ease.

Still referring to the central housing of the inventive hair applicator device, the exterior surface thereof includes a plurality of pathways disposed in a fluid flow connection with the hollow interior first chamber of the central housing. For instance, hair building material in the form of a gel-like fluid can flow freely from the interior chamber of the central housing out through the plurality of pathways on the exterior surface of the central housing, directly on to the user's hair scalp. As such, it is preferred that the plurality of pathways are located in between the plurality of bristle elements, so as to structurally coexist together on the exterior surface of the central housing.

Furthermore, the inventive hair applicator device comprises a movable member that is movably disposed within the hollow interior first chamber of the central housing. At least a majority of the length of the movable member, if not the full length of it, is enclosed within the hollow interior first chamber of the central housing. In this regard, the movable member is connected to the central housing, so as to be movable within at least a portion of the hollow interior first chamber. Correspondingly, the movable member may be powered by the power supply source disposed in the base. The power from the power supply source to the movable member enables the movable member to sonically oscillate and/or vibrate within the hollow interior first chamber of the central housing. As such, the movable member vibrates and/or oscillates at a frequency that is sufficient to create a mechanical shear stress in the hair building material, when the movable member is introduced to it. The stress due to the vibrating movable member results in the hair building material decreasing its viscosity, thereby causing it to liquefy from its original gel-like form. The liquefaction of the hair building material releases or "squeezes out" the hair building material from its containment, meaning within the cartridge assembly.

Additionally, in the preferred embodiments, the movable member will be structured to have an external surface configuration that is stepped, so as to have a lowest portion with a widest outer diametric dimension than an adjacent portion, which in turn has a wider outer diametric dimension that an uppermost or top portion. This stepped configuration, which effectively tapers from a wide to narrow diametric dimension from the lower portion to the top portion of the movable member, allows a user to operably connect the base to the central housing, and further, with the movable member mounted on the base being structured so as to be received within mating structure associated with a receiving member disposed within the central housing. Given this, the stepped external configuration of the movable member allows for a secure attachment within the receiving member, ensuring a secure fit of the base, operably connecting it to the housing. In the preferred embodiment, the secure connection of the movable member into the receiving member allows the receiving member to also vibrate and oscillate when the movable member is in operational use.

The inventive hair applicator device further comprises a cartridge assembly, cartridge, or a canister. In a preferred embodiment, the cartridges can be categorized as a first cartridge assembly and a second cartridge assembly. Each of the cartridge assemblies contains at least a portion of the hair building material. Accordingly, in a preferred embodiment, the first cartridge assembly containing the hair building material is sized, structured and configured to be received within the hollow interior first chamber of the central housing.

More specifically, and while the cartridge assembly could easily assume other embodiments within the spirit and scope of this invention, the first cartridge assembly will preferably have an open end and a penetrable closed end that is structured to receive the movable member, upon application of a suitable predetermined force by the user. For instance, the movable member is structured to penetrate through the penetrable closed end of the first cartridge assembly, when the user applies the suitable amount of force. To further illustrate this, a suitable force is applied by the user in directing the first cartridge assembly into and fully inserting it within the hollow interior first chamber of the central housing, with the penetrable closed end of the first cartridge assembly directly facing the movable member disposed inside the hollow interior first chamber of the central housing. As such, the first cartridge assembly containing the hair building material is inserted into the hollow, interior first chamber of the central housing. Given this, it is important to note that the outer diametric dimensions of the first cartridge assembly are preferably close to but slightly smaller than the inner diametric dimensions of the central housing and its hollow interior chamber, so as to create a frictional fit between them. The frictional fit ensures that the first cartridge assembly will remain in place during use, despite the vibrational movement of the movable member, and also allows for the first cartridge assembly to be removed from the hollow interior first chamber of central housing, when that is desired. To further illustrate, as force is continued to be applied on the first cartridge assembly during its insertion into the housing, the penetrable closed end establishes contact with the movable member. As such, the movable member is sized, structured and configured to penetrate within the first cartridge assembly. Moving forward, as the insertion of the first cartridge continues and the contact signifies, the movable member penetrates so as to intrude through the penetrable, closed end of the cartridge, exposing itself to the hair building material contained therein. As a result, the movable member is exposed directly to the hair building material contained in the first cartridge assembly. Additionally, the force applied to the first cartridge assembly should be sufficient to frictionally secure a majority portion of the first cartridge assembly within the hollow interior first chamber of the central housing, so as to ensure that the first cartridge assembly is removably affixed on the movable member when in operational use.

Furthermore, the first cartridge assembly has an exterior surface extending between the two ends thereof, and further, includes at least one slit communicating with the interior of the cartridge assembly containing the hair building material. This slit can be aligned with the plurality of pathways disposed on the central housing, as for instance, by inserting the first cartridge assembly into the hollow interior first chamber of the central housing, and rotationally moving it there-within, so as to align the slit in the same direction of fluid flow travel with the plurality of pathways. So, once the first cartridge assembly is rotated into the preferred alignment, the hair building material contained in the cartridge, once liquefied, is ready to freely flow out through the slit of the first cartridge assembly, and to pass through the plurality of pathways on the exterior surface of the outer wall of the central housing and out, onto the plurality of bristles.

The device of the present invention further comprises a second housing connected to the central housing at an upper surface thereof. The second housing has an exterior surface with a plurality of openings that are in a fluid flow connection with the plurality of bristle elements. Accordingly, as the hair building material contained in the second cartridge assembly inserted in the second housing flows through the plurality of openings, it is directed to simultaneously blend with the hair building material from the first cartridge assembly contained in the central housing flowing through the plurality of pathways. More specifically, the second cartridge assembly includes an outer wall with an exterior surface extending the length thereof. The outer wall of the second cartridge assembly includes and is structured to define at least one incision extending completely through and between the exterior surface and an interior surface thereof, so as to allow the one or more ingredients of the hair building material carried inside the second cartridge assembly to freely flow out of and through the incision.

Given this, the second cartridge assembly containing additional hair building material (such as, for example, another type of hair building material or a hair coloring material) is inserted into a hollow interior second chamber of the second housing. As such, the hollow interior second chamber of the second housing is sized, structured and configured to receive and secure the second cartridge assembly there-within. Accordingly, the user inserts the second cartridge assembly within the hollow interior second chamber of the second housing and rotationally aligns the incision on the exterior surface of the second cartridge assembly with the plurality of openings of the second housing so as to ensure that the incision on the second cartridge assembly is in a fluid flow connection with the plurality of openings disposed on the second housing. As a result of this, the additional hair building material contained in the second cartridge assembly is able to flow relatively freely through and out from the incision of the second cartridge assembly, passing through the plurality of openings disposed on the second housing and out, onto to the user's hair or scalp. Furthermore, the second cartridge assembly is preferably also structured to be frictionally fit within the hollow interior second chamber of the second housing. As such, the outer diametric dimensions of the second cartridge assembly are ideally also about the same but slightly smaller than the inner diametric dimensions of the second housing, so as to create a frictional fit, and as such, secure at least a portion of the second cartridge assembly within the hollow interior second chamber of the second housing. Moving forward, as the force is continued to be applied on the second cartridge assembly as it is inserted into the second housing, the frictional fit secures a majority portion of the second cartridge assembly within the hollow interior second chamber of the second housing, so as to ensure that the second cartridge assembly is operationally in use and yet also removably affixed therein to allow for being replaced with another cartridge assembly having a fresh supply of hair building material or for the refilling of the cartridge assembly.

It will be appreciated that in a preferred embodiment, one or more additional types of hair building material can be contained in the second cartridge assembly that is inserted into the second housing, and that once the incision thereof is aligned with the plurality of openings formed in the second housing, this hair building material can flow through and out from the incision, pass through the plurality of openings, and blend with the other type of hair building material contained in the first cartridge assembly, which flows through the plurality of pathways, to dispense directly on to the user's hair or scalp, as the plurality of bristle elements are contacting and engaging the user's hair and/or scalp. While not necessary, this occurs concurrently as the user brushes the inventive device directly on the user's hair scalp. It is also most preferred in an embodiment that either of a dry powder and/or a fiber like strand format of one or more ingredients of the hair building material is carried individually and/or collectively in the second cartridge assembly.

The inventive hair applicator can include, in another preferred embodiment, a third housing. In this embodiment, the third housing will preferably be connected to the central housing at an upper surface thereof, and similar to central housing, is formed of a rigid material so as to have a first closed end, a second open end and a hollow interior third chamber. As such, the hollow interior third chamber is sized, structured and configured to receive a cartridge assembly identical to the second cartridge assembly. Furthermore, the third housing also comprises an outer body wall between said first and second ends with a plurality of slots formed within it. As such, the third housing is also in a fluid flow connection with the plurality of bristle elements.

In this regard, additional ingredients used as hair building material can be contained in another or separate second cartridge assembly and can freely flow through and out from the incision formed therein, and also pass through the plurality of slots, and consequently, on to the user's hair scalp to blend with one or more ingredients dispensed from the first cartridge assembly located within the central housing and the other second cartridge assembly located within the second housing. In other words, in one preferred embodiment and while not always necessary, one or more ingredients of the hair building material contained in the second cartridge assembly inserted in the third housing flows through the plurality of slots, to simultaneously be blended with on the user's hair and scalp, one or more ingredients of the hair building material contained in the second cartridge assembly inserted in the second housing flowing through the plurality of openings, and to further blend with one or more ingredients contained in the first cartridge assembly inserted in the central housing flowing through the plurality of pathways. The processing of all the ingredients collectively, occurs as the device is engaged on to the user's hair scalp and/or hair.

Furthermore, the inventor herein contemplates that the inventive device may include only two housings. By way of an example only, in this alternative embodiment each of the two housings can be structurally and functionally identical and generally similar to the housing described in earlier embodiments. Accordingly, one of the two housings can have the plurality of bristles attached thereto. Additionally, given this embodiment, it will be appreciated by those skilled in the art that at least one cartridge inserted in one of the two housings, contains the hair building material in the gel-like form, while at least one cartridge inserted in the other of the two housings, contains the hair building material in the form of, but not limited to dry powder, fiber-like strands, hair coloring agent(s) and/or structural combination thereof. As such, the processing, blending and dispensing of the hair building materials in this alternative embodiment of two housings will work substantially similar to the aforementioned preferred embodiments. Additionally, in this alternative embodiment, the base still has the movable member mounted thereon, and while the base could be structured to include a dual or second movable member, it is preferably a single movable member connected to the base and still also removably connected to the central housing. As a result, and similar to the operational features mentioned in embodiments earlier, the hair building material contained in one of the cartridges inserted into one of the two housings is penetrated by the movable member, sonically blended by the vibration, and dispensed directly on to the user's hair to blend with the hair building material contained in one of the other cartridges inserted in the other of the two housings. As a result, the hair material contained in each of the cartridges in each of the two housings collectively may be dispensed onto the user's hair, when the inventive device is in operative use.

Looking even further, the inventor herein also contemplates that the inventive device may include only one housing. In this additional preferred alternative embodiment, the inventive device comprises a base with a movable member and one housing with plurality of bristles connected thereto. As such, the user connects the housing with the plurality of bristles to the base, which has the movable member mounted thereon. To illustrate this further, as the user attaches the housing to the base, the movable member mounted on the base is structurally received within an inner cavity of the housing. As such, the inner cavity of the housing is sized, structured and configured to receive the movable member so as to ensure a secure fit. Similarly, as described in earlier preferred embodiments, the movable member is structured to vibrate and/or oscillate at a frequency that allows the entire inventive device to vibrate as well. As such, the movable member is connected to a power supply that ensures its vibration when actuated. To further illustrate, the operational features in this embodiment, the user frictionally attaches the cartridge or cartridge assembly containing the hair building materials in the housing. However, even in this additional alternative embodiment, the movable member will preferably vibrate so as to cause the plurality of bristles to also vibrate as the user applies the hair building material on his or her hair. As a result, and similar to the operational features mentioned in embodiments earlier, the hair building material contained in the cartridge inserted into the housing is penetrated by the movable member, sonically blended by the vibration, and dispensed directly on to the user's hair as one complete blend of the hair building material containing all the ingredients necessary to promote hair building attributes on the user's scalp. More specifically, the one cartridge inserted within the housing, contains the hair building material in the form of gel, dry powder, fiber-like strands, hair coloring agent(s) and/or structural combination thereof. Therefore, it may be appreciated by a person skilled in the art that the hair material contained in the cartridge in the housing would be blended all together internally within the cartridge, before it will be collectively dispensed as a complete hair building material comprising of all the ingredients necessary to promote hair building attributes onto the user's hair, when the inventive device is in operative use.

The inventor herein has also conceived of yet another embodiment for his inventive device. In this additional alternative embodiment, the inventive device comprises a base with a movable member and a bristle holder, but does not include a central housing or any other housing. As such, the user securely connects the bristle holder to the base, which has the movable member mounted thereon. To illustrate this further, as the user attaches the bristle holder on to the base, the movable member mounted on the base is structurally received within an inner cavity of the bristle holder. As such, the inner cavity of the bristle holder is sized, structured and configured to receive the movable member so as to ensure a secure fit. Similarly, as in earlier preferred embodiments, the movable member is structured to vibrate and/or oscillate at a frequency that allows the entire inventive device to vibrate as well. As such, the movable member is connected to a power supply that ensures its vibration when actuated. To further illustrate the operational features in this embodiment, the user simply dips the plurality of bristles in each of the hair building material located within an external container and can thereby apply it directly onto the user's scalp and/or hair. However, even in this additional alternative embodiment, the movable member will preferably vibrate so as to cause the plurality of bristles to also vibrate as the user applies the hair building material on his or her hair.

Also in a preferred embodiment, the inventive hair applicator device comprises of a mirror attachment. The mirror attachment is connected to the central housing and is pivotally disposed in an opposing relation to the plurality of bristle elements on the exterior surface of the central housing. In other words, the mirror attachment is positioned on the opposite side of the plurality of bristle elements. This positioning of the mirror attachment can be deliberate in order to help the user get a visual outlook of the hair building activity during application.

Furthermore, in one of the preferred embodiments, the mirror attachment is detachable. The detachment allows the user to remove the mirror attachment, if and when not desired. As such, the mirror attachment can be detached from its connection to the central housing, and reattached when desired. To further characterize this, the central housing has a connecting member structured to receive and removably secure the mirror attachment to the central housing. Accordingly, it may be appreciated that in one of the preferred embodiments, the mirror attachment can be connected to the central housing in a snap fit, press-fit or other similar type of joint fit connections that allow the user to attach and detach the mirror attachment from the central housing, as and when preferred. Comparatively, in one of the other preferred embodiments with one housing, the housing has at least two connecting members. As such, each of the two connecting members are structured to receive at least a portion of the mirror attachment, sufficient to removably secure the mirror attachment to the inventive device. Alternatively, in one of the embodiments, the mirror attachment can also be permanently affixed to the central housing so as to avoid any detachment.

Additionally, the connected mirror attachment can be pivotally moved back and forth from a closed position to an open position. To further illustrate this, the closed position allows the mirror attachment to be folded in a manner that allows the mirror attachment to be sufficiently aligned with the central housing. This alignment results in a parallel positioning of the mirror attachment relative to the plurality of bristle elements on the exterior surface of the central housing. Additionally, the pivotal nature of the mirror attachment improves visibility, particularly when the device is used to focus on specific areas of the hair scalp for concealment.

Furthermore, it will be appreciated from the description above and by those skilled in the art that in the preferred embodiments, one or more components of the hair applicator device are detachable from the base, such as the central housing and other housing(s), mirror, etc. Thus, for example, the mirror attachment and the housing with the plurality of bristles can be collectively detached from the base. For instance, while attaching the base to the housing, the user may align the housing with the stepped configuration, slide it into place on the base and rotate the base to securely connect it to the housing. More particularly, as the base is secured to the housing, the movable member mounted on the base is substantially received within the hollow interior chamber of the housing so as to ensure a secure fit. Additionally, and as has been noted previously, the housing can have a first open end and a second open end, but when the base is secured to the housing, the second open end closes to form a closed end.

Comparatively, when detaching the base from the housing, the base is rotated in an opposite direction relative to the housing. This opposite rotation allows the base to disengage from the housing, and be detach therefrom. More particularly, as the base is detached from the housing, the movable member mounted on the base is released from its secure fit in the hollow interior chamber of the housing. Additionally, the closed end of the housing is re-opened into the second open end. To further illustrate this preferred embodiment in a detailed manner, the base is secured to the housing during attachment by a retention member disposed on the movable member. As a result, when the base is rotated in e.g., a counter-clockwise direction relative to the housing and inserted therein, the retention member disposed on the movable member and positioned inside the housing, secures the base to the housing, sufficient to present the inventive device as a one piece construction. Alternatively, as the base is turned in e.g., a clockwise direction relative to the housing, the retention member unlocks and releases the base from the housing, sufficient to illustrate the inventive device as a two piece construction, one being the base and the other being the combination of the mirror attachment, the housing and the plurality of bristles attached thereto.

In an alternative embodiment, the hair applicator device of the present invention can include a compression member. The compression member in one alternative embodiment is disposed within the hollow interior first chamber of the central housing. As such, the compression member is sized, structured and configured to connect to the cartridge or the cartridge assembly, including but not limited to the first cartridge assembly and/or the second cartridge assembly. As such, and merely as an illustration, pressure is generated within one or more ingredients of the hair building material carried in the cartridge assembly is securely connected to the compression member disposed within the hollow interior first chamber of the central housing. This is accomplished when a predetermined force is exerted on the cartridge assembly towards the compression member, sufficient to secure the cartridge assembly on to the compression member. Accordingly, the predetermined amount of force in connecting the cartridge assembly to the compression member induces sufficient pressure to causes one or more ingredients of the hair building material contained in the cartridge assembly to forcibly release through and from the slit, incision, or access opening through the plurality of pathways directly on to the plurality of bristle elements disposed on the exterior surface of the central housing.

Additionally, one or more ingredients of the hair building material can form a dry powder blend comprising all or some of the hair building ingredients. Furthermore, the hair building material can also be in the form of fibers that resemble hair like strands comprising all or some of the hair building ingredients. As such, the fiber resembling hair like strands may further comprise natural or synthetic colored pigments and/or activated charcoal. Given this point, the hair like fibers and the powder blend of the hair building material can be stored in one cartridge or cartridge assembly, or preferably in separate, individualized cartridges or cartridge assemblies. Accordingly, merely as an example, the powder and the fiber forms of the hair building material can be contained in one cartridge, namely second cartridge assembly or contained in separate second cartridge assemblies. To further illustrate this, in one embodiment, the second cartridge assembly containing either the powder or fiber forms of the hair building material is inserted in the second housing of the device, while another second cartridge assembly containing either the powder or fiber form of the hair building material is inserted in the third housing of the inventive device. Additionally, at least one separate cartridge, preferably the first cartridge assembly, containing hair building material in a gel-like form is inserted in in the central housing of the inventive device.

Furthermore, the hair building material is preferably stored in the cartridge or the cartridge assembly including, but not limited to first cartridge assembly and second cartridge assembly. However, it can also be stored in other forms of containers such as a tub, jar, plastic bag, or any other apparatus, that are sized, structured and configured to be received and secured in the central housing, second housing, and third housing, and concurrently while maintaining the fluid flow connection as illustrated earlier.

Additionally, in an embodiment of the device of the present invention, each of the second cartridge assemblies can be connected to a sleeve member having a sleeve cap. The sleeve member and the sleeve cap can help the user rotate the second cartridge assembly into the housings. Alternatively, however, the any and all of the cartridge assemblies can be free of any connections to the sleeve member and inserted and/or rotated into the first, second or third housing securely. Furthermore, in an embodiment of the inventive device, the plurality of bristles, the central housing, the secondary housing, the third housing and the mirror attachment are collectively detachable from the base. In this regard, it is ensured that the user is able to use the inventive device for spot treatment on the affected areas of the hair scalp by easily carrying the device in the pocket, thus making it effortlessly maneuverable and accessible.

Furthermore, in one of the preferred embodiments of the device of the present invention, the cartridge or cartridge assembly may not necessarily have a penetrable closed end. As such, the cartridge may have a closed end and an open end that is sealed with a sealing member before the cartridge or cartridge assembly is operationally put to use. To further illustrate this point, the user would peel off or remove the sealing member as the cartridge is ready to be inserted within the housing. Similarly, in the relevant embodiments, the access opening, slit or incision on the cartridge assembly may also be sealed with the sealing member. To further illustrate this, the user can peel or remove the sealing member off the access opening, slit, or incision of the cartridge assembly as it is ready to be inserted into the housing. Alternatively, in one of the preferred embodiments, the user may simply peel off the sealing member on the access opening, but retain the sealing member on the open end. This may allow the movable member to contact and easily penetrate the sealing member on the open end and ensure its exposure with the hair building material contained therein, when the cartridge is inserted into the housing using suitable force.

It is an object of the present invention to provide the user with a hair building solution that is substantially compact and highly efficient device for storing and dispensing hair building material, without requiring substantial modification or alternation of the existing structure.

It is a further object of the present invention to provide a device for storing and dispensing hair building material, which can be easily used, low in cost, portable in nature and inexpensive to manufacture.

It is still another object of the present invention to provide a device for storing and dispensing hair building material, which can effectively create hair building fibers for a fuller look of hair on the user's scalp by introducing the hair building material with mechanical sheer stress or mechanical friction.

Yet another object of the present invention is to provide a device for storing and dispensing hair building material, which can be used with power supply or without power supply and can also function as a daily solution for hair loss or spot treatment.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 3 is a perspective view of the second cartridge assembly that is utilized with the inventive device according to one of the preferred embodiments.

FIG. 3A is a perspective view of the third cartridge assembly that is utilized with the inventive device according to one of the preferred embodiments.

FIG. 5 is a perspective view of the first cartridge assembly having an open end and a closed, penetrable end in one of the preferred embodiments.

Like reference numerals refer to like parts throughout the several views of the drawings.

DETAILED DESCRIPTION OF THE PREFERRED EMBODIMENT

The present invention is directed to a new and improved device, generally indicated as 10, for storing, processing and dispensing hair building material. More specifically, the device 10 is structured to store, process, and dispense different portions of the hair building material, wherein each portion may include different ingredients. Further, each of the different portions and corresponding ingredients of the hair building material may be independently stored on the device 10. In addition, the different portions are concurrently dispensed and substantially or partially blended with one another in the area of a plurality of bristles 60 prior to and concurrent with application of the blended hair building material onto the hair and scalp of the user.

The inventive device 10 can be utilized on a variety of different hair types, hair textures and colors. Additionally, the inventor hereof has developed a unique and proprietary hair building composition intended for primary use as the hair building material to be stored, processed, and dispensed by the device 10. However, it is emphasized that the inventive device 10 could also be used to store, process and dispense a variety of other hair building materials, containing one or more ingredients. As such, each of the embodiments of the device 10 as well as the scope of the present invention should not be limited to use with the unique hair building composition described in detail herein.

Figure 1:
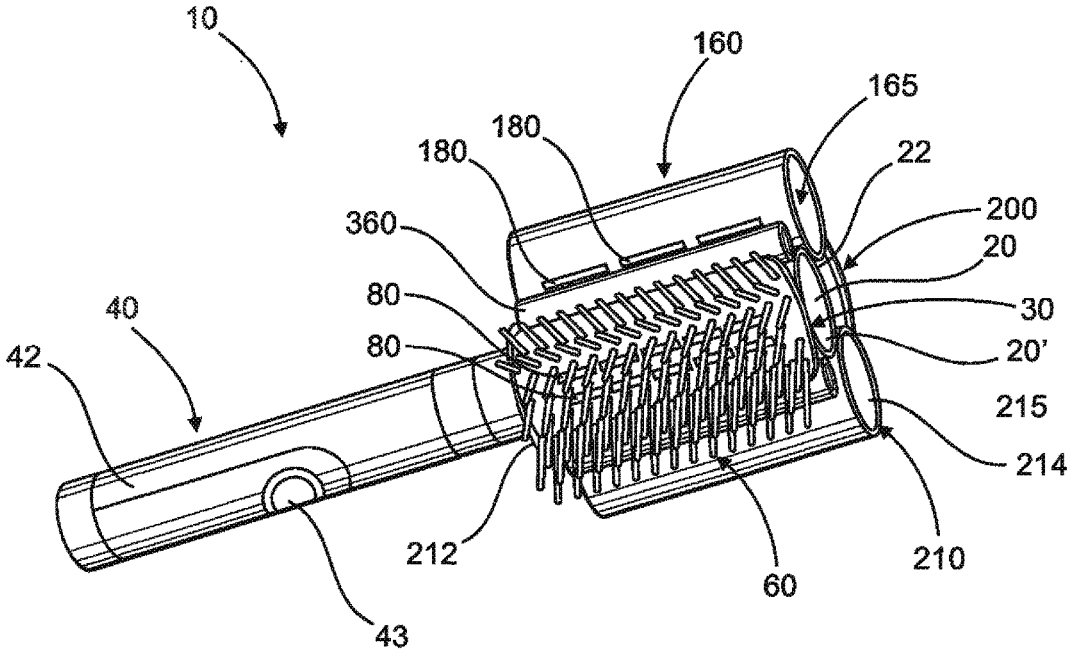
FIG. 1 is a perspective view of the inventive device according to one of the preferred embodiments.
Figure 2:
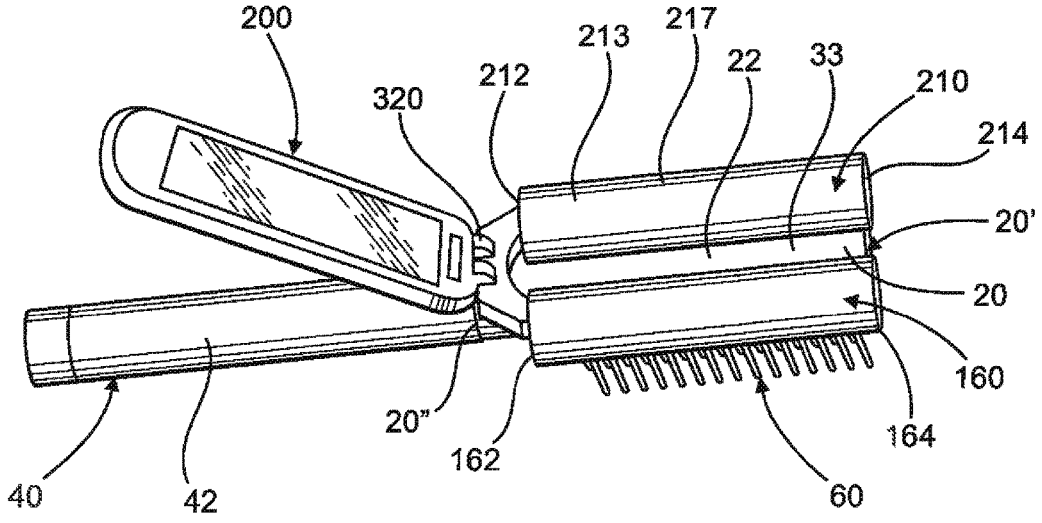
FIG. 2 is also a perspective view of the inventive device in accordance with the present invention, but illustrating one of the preferred embodiments including a mirror attachment in an open orientation.

Referring now to FIGS. 1 and 2, the device 10 of the present invention is illustrated in one preferred embodiment and is seen to include a base 40 having a central or first housing, 20 connected thereto. The first housing 20 is defined by a body or wall 22 that may be, but is not limited to, a generally cylindrical shape. Further, the housing 20 includes an open end 20', a second, oppositely disposed closed end 20", and a hollow interior or first chamber 30. The housing 20 is sized, structured, configured to receive a first supply of the hair building material, which may be in the form of a first cartridge assembly 120 as shown in FIG. 5. As indicated, the first supply of hair building material comprises one of a plurality of portions of the hair building material which are eventually blended with one another. Accordingly, as shown in FIG. 5, the first supply and/or cartridge 120 comprises a predetermined portion of the hair building material and may include one or more ingredients thereof disposed within its hollow interior 30. Also, as shown in FIGS. 1 and 2, the first housing 20 is constructed of a generally rigid material and at its closed end 20" is connected to a corresponding portion of the base 40. Further, the base 40 includes a handle or grip 42 which is preferably structured to be easily grasped by a user of the device 10 for manipulation thereof, thereby facilitating its use in a manner similar to a common hairbrush or comb.

Furthermore, the body 22 of the housing 20 has an exterior surface 33 disposed adjacent to and/or in communication with the plurality of bristle elements 60 connected to the base 40, in a generally communicating relation with the first housing 20 and first supply and/or cartridge 120 contained therein. In addition, a plurality of apertures or pathways 80 define a flow path or path of fluid flow for the portion of the hair building material contained within a corresponding or first cartridge 120 within the housing 20. Each of the plurality of apertures or pathways 80 are formed in the body 22 so as to define a flow path of the hair building material from the cartridge to the bristle 60. Also, each of the apertures or pathways 80 are sized, structured, and configured to accommodate the consistency of the ingredients of the portion of the hair building material within the first cartridge 120. The flow path of the corresponding portion of the hair building material being at least partially defined by the plurality of apertures 80 facilitates its delivery from the interior of a corresponding first cartridge, to the plurality of bristles 60 once it is blended with the other portions of the hair building material, as described hereinafter. Further, in the embodiment of FIG. 1, the plurality of pathways or apertures 80 defining a part of the aforementioned flow path may be disposed to deliver the corresponding portion of the hair building material between the bristle elements 60.

The plurality of bristles 60 are structured to create a mechanical friction on the user's scalp as the hair building material is dispensed thereon. More particularly, the plurality of bristles 60 are movable due to the oscillation and/or vibrations of the inventive device 10 in the embodiment including a motor and/or are movable manually by the user's movement in brushing his or her hair. It should be evident that the motorized or non-manual movement of the plurality of bristles 60 can be provided by a power supply source disposed in the base 40 of the inventive device 10.

That is, and in at least one embodiment of the present invention, the base 40 and/or handle portion 42 is/are structured to include a drive motor and appropriate drive linkage, which is not shown in the drawings. Further, at least one actuator switch 43 is operatively connected to a power supply, also not shown for purposes of clarity. Suitable wiring and/or control circuitry may also be disposed within an interior of the base 40 for connection to the power supply. The power supply may be a self-contained battery carried within an appropriate portion of the base 40 and/or handle 42. In the alternative, the device 10 can also be operated with other electric power sources, such as being connected by an appropriate cord or the like to a common electrical outlet. Also, the base 40 can be sealed to prevent any water damage.

Therefore, in use, activation of the aforementioned drive motor through manipulation of the activating switch 43 will exert a vibrational force on at least a portion of the base 40 associated with the mounting or connection of the plurality of bristles 60 and on one or more housings, specifically including the first housing 20. As explained in greater detail hereinafter, such a vibratory force will be sufficient to facilitate dispensing of the various portions of the hair building material from each of a possible plurality of hair building material supplies or cartridges 120 can located in different ones of a plurality of housing on the base 40. However, it is to be noted that in an alternative embodiment, the device 10 can function manually, requiring no power, as described subsequently herein.

Figure 4:
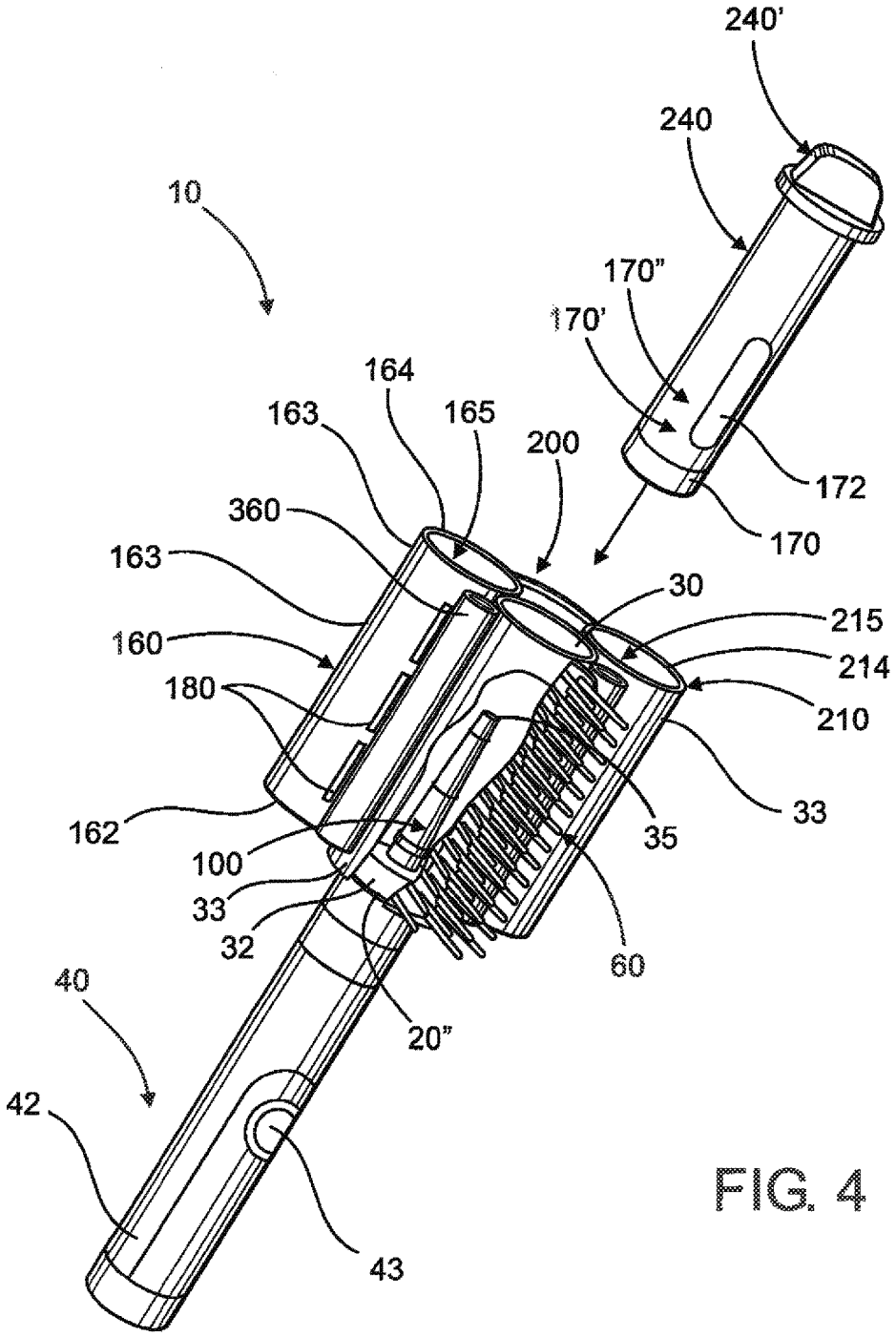
FIG. 4 is an exploded view in partial cutaway of the device shown in FIG. 1 illustrating insertion of the second cartridge assembly into a third housing according to one of the preferred embodiments.

With further regard to the generation of a vibratory force and with primary reference to FIG. 4, the device 10 may further comprise a movable member 100 connected to and at least partially, movably disposed within hollow interior 30 of the first or central housing 20. The movable member 100 is formed of a rigid material, and has a first end 32 connected to the closed end 20" of the housing 20. An opposite distal end 35 preferably includes a pointed configuration, wherein at least a portion of the movable member 100, including the distal end 35, is at least partially enclosed within the hollow interior 30 of the first housing 20. When so disposed, the distal end 35 may be disposed in connecting, penetrating, etc. relation to the first cartridge, such as 120, disposed within the hollow interior 30. In use and as at least partially as described above, the movable member 100 may be electronically connected in driven relation to the drive motor contained within the base 40 and/or handle 42. Once activated, through appropriate electrical and mechanical connection between the movable member 100 and the self-contained drive motor, the movable member 100 will sonically oscillate and/or generate a vibratory force. This vibratory force is transferred to the cartridge 120 within the hollow interior 30 as well as the portion of the hair building material contained therein. Such vibratory force exerted on or transferred to the first cartridge 120, as well as its contents will be sufficient to vary the viscosity of the hair building material to the point where it may be at least partially liquefied. By way of example only, the portion of the hair building material retained within the cartridge 120 may be in a gel-form. As such, the viscosity of such a gel must be reduced, possibly to the point of being at least partial liquefied, so as to facilitate the dispensing of the gel-like portion along the flow path from the cartridge 120 and out of the access openings or apertures 80 formed in the first housing 20.

Figure 11:
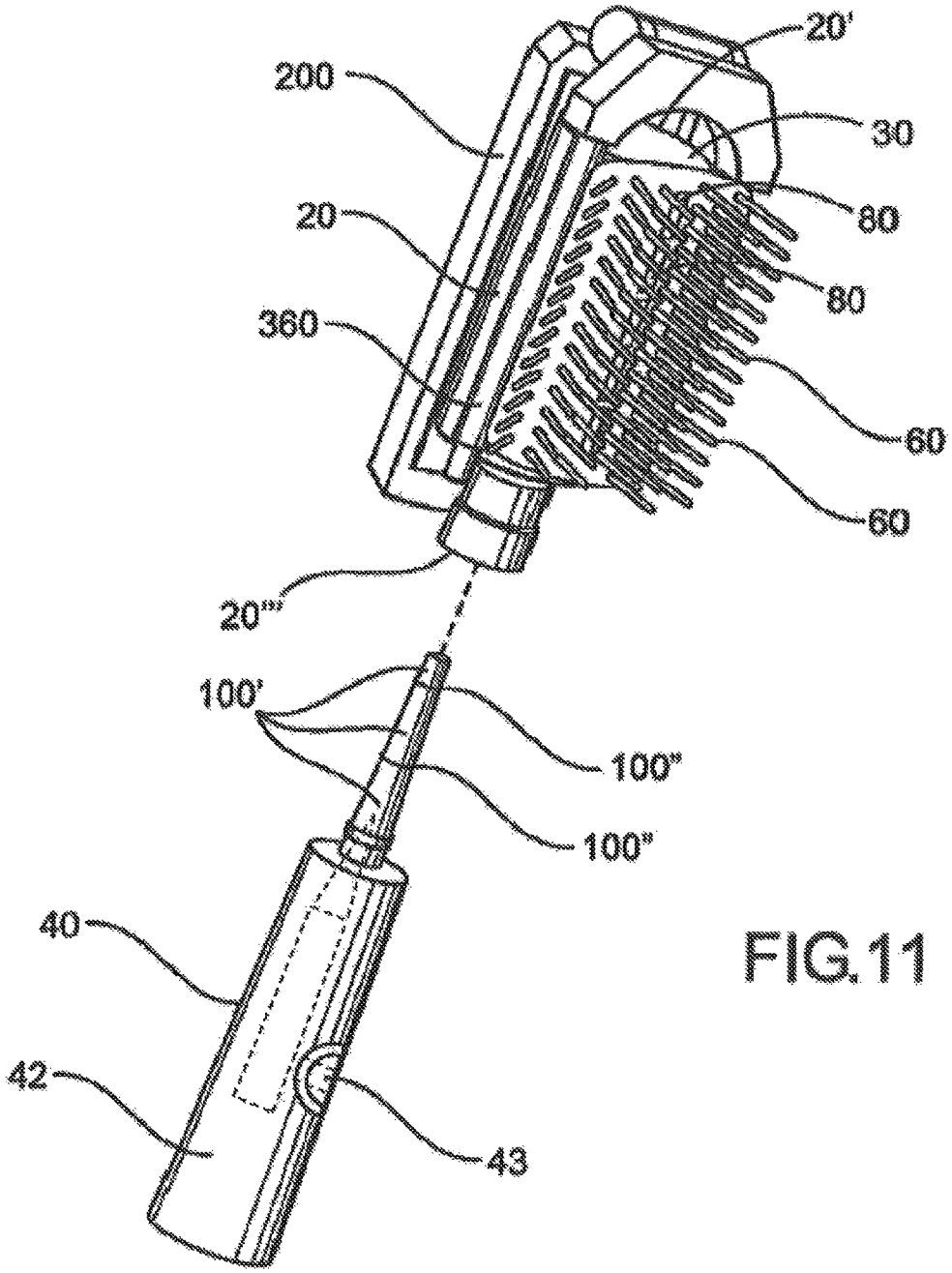
FIG. 11 is an exploded view of the inventive device illustrating the base with the movable member mounted thereto, detached from the housing according to one of the preferred embodiments.
Figure 12:
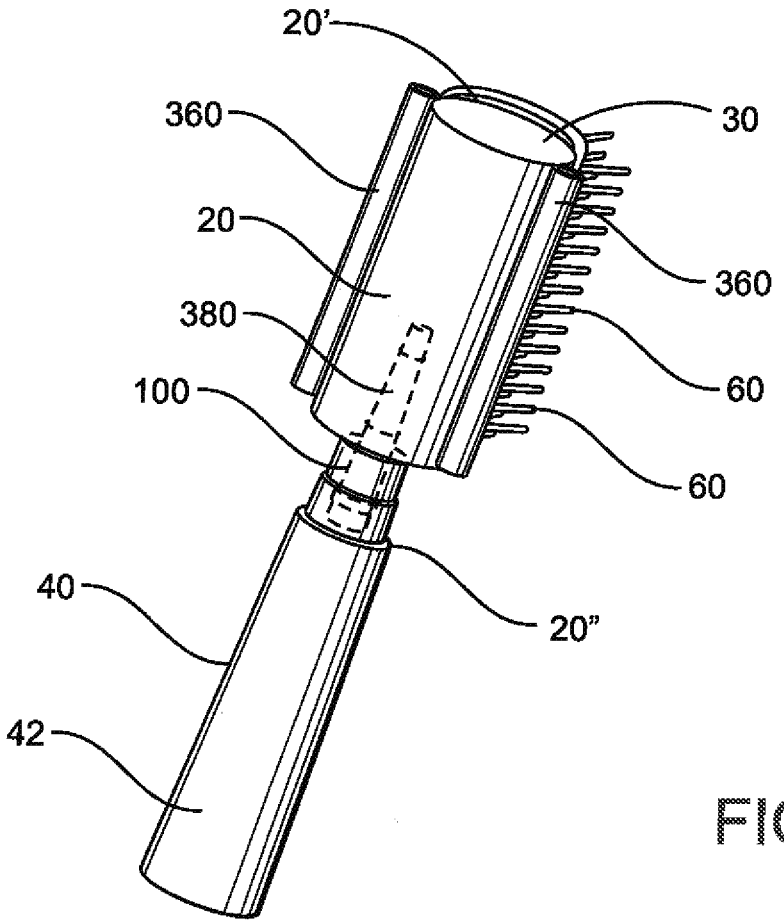
FIG. 12 is a perspective view in partial phantom of the inventive device illustrating the movable member disposed within the hollow interior chamber of the housing, when the base is attached to the housing according to one of the preferred embodiments.

With further regard now to another one of the preferred embodiments, and as shown in FIGS. 11 and 12, the movable member 100 can be structured to have external surface configuration that is stepped as at 100', so as to have a lowest portion with a widest outer diametric dimension than an adjacent portion, which in turn has a wider outer diametric dimension that an uppermost or top portion. This stepped configuration on the movable member creates a ledge 100" around each of the layers, approximately where the plurality of steps 100' connect to each other. Accordingly, when the user connects the base 40 to at least one housing 20, the movable member 100 mounted on the base 40 is structured to be received within a receiving member 380 disposed within the housing 20. More particularly, the stepped exterior configuration of the movable member 100 allows for it to be removably secured to the receiving member 380, and helps to ensure a secure fit of the base 40 to the housing 20 for operation of the device. In the preferred embodiment, the secure connection of the movable member 100 into the receiving member 380 allows the receiving member 380 to also vibrate and oscillate when the movable member 100 is in operational use. Additionally, in this preferred embodiment, the movable member 100 has a retaining member 380 disposed on it and structured to facilitate a removably secure fit to at least one housing 20.

With further regard to the interaction and the exertion of vibratory force by the movable member 100 on to the cartridge 120, primary reference is directed to FIG. 5. As represented, the first supply of supply hair building material is in the form of the first cartridge assembly 120. The portion of the hair building material contained within the cartridge may be in a gel-like form and/or material and include one or more ingredients to be dispensed onto a user's hair and/or scalp, subsequent to blending with other portions of the hair building material. As also indicated, the first cartridge assembly 120 is sized, structured and configured to be received within the hollow interior chamber 30 of at least the first housing 20. The first cartridge assembly 120 includes an open end 120' and a penetrable closed end 120". The closed end is structured to be pierced by the pointed configuration of the end 35 of the movable member 100, upon the application of a suitable force, being exerted on the cartridge 120 when placed within the interior 30 of the housing 20. As such, the movable member 100 can penetrate through the closed end 120" of the first cartridge assembly 120 when the user exerts a suitable predetermined force on the cartridge 120. The exertion of the predetermined force and resultant penetration of the closed end 120", serves to connect the first cartridge assembly 120 to the movable member 100 inside the hollow interior 30 of the housing 20. As a result of this connection, the exertion of a vibratory force by the movable member 100 will result in a reduction of the viscosity of the portion of the hair building material within the cartridge 120 to a point of possible liquidation.

As also illustrated in FIG. 5, the first cartridge assembly 120 includes an outer wall 133 with an exterior surface 130 extending the length thereof between the open end 120' and penetrable closed end 120". The outer wall 133 of the first cartridge assembly 120 also includes and is structured to define at least one access opening or slit 140 completely through and between the exterior surface 130 and an interior surface thereof so as to allow one or more ingredients of the hair building material carried inside the first cartridge assembly 120 to flow out of and through the access opening or slit 140. Preferably, this slit 140 extends longitudinally along at least a portion of the outer wall 133 and ideally along a majority of the length thereof. Additionally, in use of the inventive device 10, the access opening or slit 140 can be aligned with the plurality of apertures or pathways 80 on the body of the central housing 20 to further define the flow path of the hair building material.

The aligning is accomplished by rotating the first cartridge assembly 120 within the hollow interior 30 of the housing until the access opening or the slit 140 is preferably facing and/or in communicating relation to the plurality of apertures or pathways 80 formed in the housing 20. As a result, of such communicating relation the flow path for the hair building material is at least partially defined. Further, the one or more ingredients and/or portion of the hair building material carried by the first cartridge 120 can flow and/or be dispensed out of the first cartridge assembly 120 through the access opening or slit 140 and through the plurality of apertures or pathways 80 on the exterior surface 35 of the housing 20 into the area of the plurality of bristle elements 60. Thereafter, the hair building material will be dispensed onto the user's scalp and/or hair as the user uses a device 10 in a conventional hair brushing manner. Once dispensed into the area of the plurality of bristle elements 60, the gel-like material may be at least partially blended with other portions of the hair building material which are concurrently dispensed into the area of the bristle elements 60 from the other supplies and/or cartridges of the hair building material.

From the foregoing, it may be appreciated that the outer diametric dimensions of the first cartridge assembly 120 are substantially similar to and yet somewhat or sufficiently smaller than the inner diametric dimensions of the central housing 20 interior chamber, so as to create a frictional fit between them. The frictional fit ensures that at least a portion of the first cartridge assembly 120 is removably secured within the hollow interior first chamber 30 of central housing 20. To further illustrate, as force is continued to be applied on the first cartridge assembly 120 during its insertion into the central housing 20, the penetrable closed end 120" establishes contact with the movable member 100. As such, the movable member 100 is sized, structured and configured to penetrate within the first cartridge assembly 120. Moving forward, as the insertion of the first cartridge assembly 120 continues and the contact increases, the movable member 100 penetrates so as to intrude through the penetrable closed end 120" of the first cartridge assembly 120, exposing itself to the hair building material contained therein. As a result, the movable member 100 is exposed directly to the hair building material contained in the first cartridge assembly 120. Additionally, it is important that the force applied to the first cartridge assembly 120 is sufficient to frictionally secure a majority portion of the first cartridge assembly 120 within the hollow interior first chamber 30 of the central housing 20, so as to ensure that the first cartridge assembly 120 is removably affixed on the movable member 100 when in operational use.

As also indicated, one or more preferred embodiments of the inventive device 10 include a plurality of cartridges, respectively indicated as a second cartridge 170 and a possible third cartridge 310, as shown in FIGS. 3 and 3A. Each of the plurality of cartridges 120, 170, 310 defines an individual supply and/or different portion of the hair building material. Further, each of the plurality of first, second, third, etc. cartridges are disposed in a different one of a possible plurality of housings, each of which are connected to or mounted on the base 40. Therefore, the device 10 will be structured to provide for the substantial blending of the different portions of the hair building material originally contained in and dispensed from a plurality of different supplies, which may be in the form of the canisters, as set forth above. Moreover, such substantial blending and concurrent dispensing will occur in the area of the plurality of bristles 60 and/or the hair and/or scalp of the user.

Therefore, with primary reference to FIGS. 1, 2 and 4, at least one preferred embodiment of the present invention includes the device 10 having a second housing, generally indicated as 160. The second housing 160 is preferably connected to the base 40 adjacent thereto and at an upper surface thereof and/or in cooperating relation with first housing 20. Similar to the first housing 20, the second housing 160 may be formed of a rigid material and have a first closed end 162, a second open end 164 and a hollow interior second chamber 165. The second housing 160 as shown in FIG. 4, also comprises an outer wall 163 between the first and second ends 162 and 164, having a plurality of access openings 180, so as to establish or at least partially define a flow path for the portion of the hair building material on an interior of a cartridge within the second housing 160. More specifically, the plurality of openings 180 allow the flow of one or more ingredients of the hair building material to be disbursed from a cartridge within the second housing 160 onto the user's hair and the plurality of bristles 60, while the plurality of bristles 60 are engaged in a brushing movement on the user's hair and scalp.

As represented in FIG. 3 one or more preferred embodiments of the present invention comprise a second supply of hair building material in the form of cartridge assembly 170. The second cartridge assembly 170 includes an outer wall 170' with an exterior surface 170" extending the length thereof. The outer wall 170' of the second cartridge assembly 170 also includes and is structured to define at least access opening 172 extending through the exterior surface 170" in communicating relation with the interior of the second cartridge 170. The access opening 172 is disposed and structured to allow the portion of the hair building material contained within the cartridge 172 pass from the interior thereof and along additional portions of the corresponding flow path, which may also be at least partially defined by the plurality of openings 180 in the second housing 160.

In use, the second cartridge assembly 170 containing a portion of the hair building material is inserted into the hollow interior second chamber 165 of the second housing 160. As such the hollow interior second chamber 165 of the second housing 160 is sized, structured and configured to receive and secure the second cartridge assembly 170. More specifically, the dimensions of the second housing 160 are sufficient to allow the second cartridge assembly 170 to remain secured within the hollow interior second chamber 165. When ready for use the user aligns the access opening 172 with the plurality of openings 180 on the second housing 160. More specifically, the second cartridge assembly 170 is inserted into the hollow interior second chamber 165 of the second housing 160. Once located therein the cartridge 170 may be rotated or otherwise appropriately positioned to align and establish a flow path between the access opening 172 with the plurality of openings 180 of the second housing 160 and remain secured therein. As such, rotating the second cartridge assembly 170 into alignment facilitates the portion and/or one or more ingredients of the hair building material carried in the second cartridge assembly 170 to flow along the flow path. As indicated, the flow path for the hair building material is at least partially defined by the access opening 172 and the plurality of openings 180 so as to facilitate it being dispensed onto the plurality of bristle elements 60 and/or hair or scalp of the user. As set forth above, the plurality of openings 180 on the second housing 160 are also in communication with the plurality of bristle elements 60. As a result, once the portion of the hair building material within the cartridge 170 passes through the plurality of openings 180, it is concurrently dispensed and substantially blended, with the portion of the hair building material being dispensed from the first cartridge, as at 120, within the first housing 20.

Furthermore, it is equally important to note that the second cartridge assembly 170 is structured to frictionally fit within the hollow interior second chamber 165 of the second housing 160. Given this, it is important to that the diametric dimensions of the second cartridge assembly 170 are sufficiently smaller than the diametric dimensions of the second housing 160, so as to create a frictional fit, and as such, secure at least a portion of the second cartridge assembly 170 within the hollow interior second chamber 165 of the second housing 160. Moving forward, as the force is continued to be applied on the second cartridge assembly 170 as it is inserted into the second housing 160, the frictional fit secures a majority portion of the second cartridge assembly 170 within the hollow interior second chamber 165 of the second housing 160, so as to ensure that the second cartridge assembly 170 is operationally in use and removably affixed therein.

As represented in FIGS. 1, 2 and 4, in another preferred embodiment, the applicator device of the present invention includes a third housing 210. The third housing 210 is connected to the base 40 adjacent or in operative relation to the first housing 20, ideally at an upper surface thereof. Similarly, the third housing as shown in FIG. 2, may also be formed of a rigid material and so as to include a first closed end 212, a second open end 214 and a hollow interior. The third housing 210 also comprises an outer wall 213 having a plurality of slots 217 disposed in flow communicating relation with the plurality of bristles 60. As such, the third housing 210 is sized, structured and configured to receive a third supply of the hair building material in the form of an additional cartridge therein. The third or additional cartridge may be substantially equivalent in size, structure and configuration as the second cartridge assembly 170.

More specifically, the dimensions of the third housing 210 are sufficient to allow another one of the second cartridges 170, or it structural equivalent, to be received and remain secured within the hollow interior thereof. Once disposed within the interior of the third housing 210, a third or additional one of the second cartridges 170 is aligned, such as by rotation, to dispose the access opening 172 with the plurality of slots 217 formed in the third housing 210. As a result, the flow path between the cartridge within the interior of the third housing 210 and out onto the bristles 60 is at least partially defined by a corresponding access opening formed in the inserted cartridge and appropriate openings or apertures formed in the third housing 210. As such, rotating the second cartridge assembly 170 into alignment ensures that the access opening 172 on the second cartridge 170, or other access openings 172 on a different third cartridge 310, is in a flow facilitating connection with the plurality of bristles 60.

As a result, a portion of the hair building material contained within the cartridge disposed within the third housing 210 will be dispensed along the flow path, at least partially defined by the access opening 172 in the contained cartridge within the third housing 210 and the plurality of openings contained within the third housing 210 itself. As set forth above, the portion of the hair building material within the third cartridge 310 will be concurrently dispensed and substantially blended with the other portions of the hair building material passing from the first and second cartridges 120 and 170 through the first and second housings 20 and 160 onto the plurality of bristles 60. The blended portions or ingredients of the hair building material will thereby be distributed onto the hair of the user during the performance of a combing or brushing action of the device 10.

Figure 6:
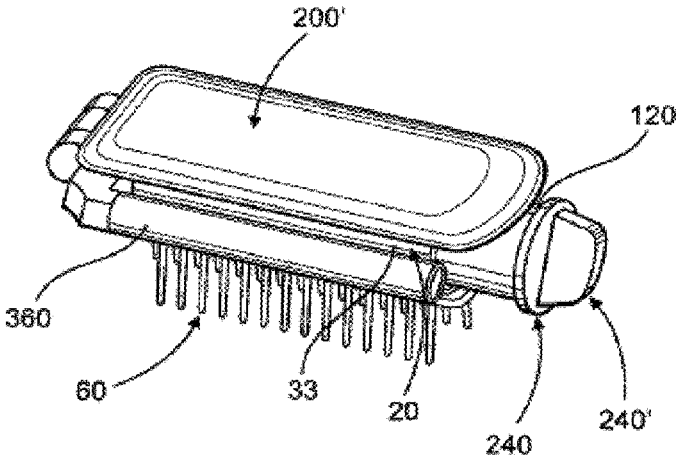
FIG. 6 is a side view of the inventive device illustrating a second cartridge assembly loaded into the hollow interior first chamber of the central housing and a mirror attachment in a closed orientation in one of the preferred embodiments.
Figure 7:
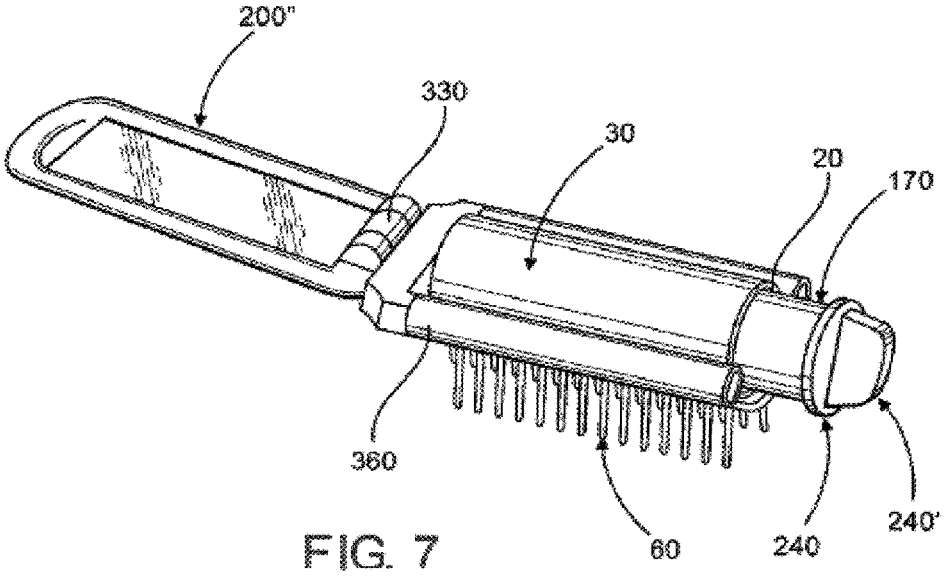
FIG. 7 is a perspective view of the inventive device illustrating the hollow interior first chamber receiving the second cartridge assembly according to one of the preferred embodiments.

With reference now to FIGS. 2, 6 and 7, one or more preferred embodiments of the present invention may include a mirror attachment or assembly, generally indicated as 200. The mirror attachment 200 is preferably connected to the base 40 adjacent to the first housing 20. In addition, the mirror attachment 200 is movably mounted and pivotally disposed relative to the exterior surface 33 of the central housing 20. As such, the mirror attachment 200 is movable and allows the user to pivot the mirror attachment 200 from a closed, substantially hidden position 200' as illustrated in FIG. 6 to an open, exposed position 200" as illustrated in FIG. 7. Additionally, the pivotal connection of the mirror attachment 200 to the central housing 20 provides a viewing and/or improved visibility to the user when applying the applying hair building material especially when the application is applied to selected areas of the user's hair and/or scalp using the inventive device 10.

Figure 8:
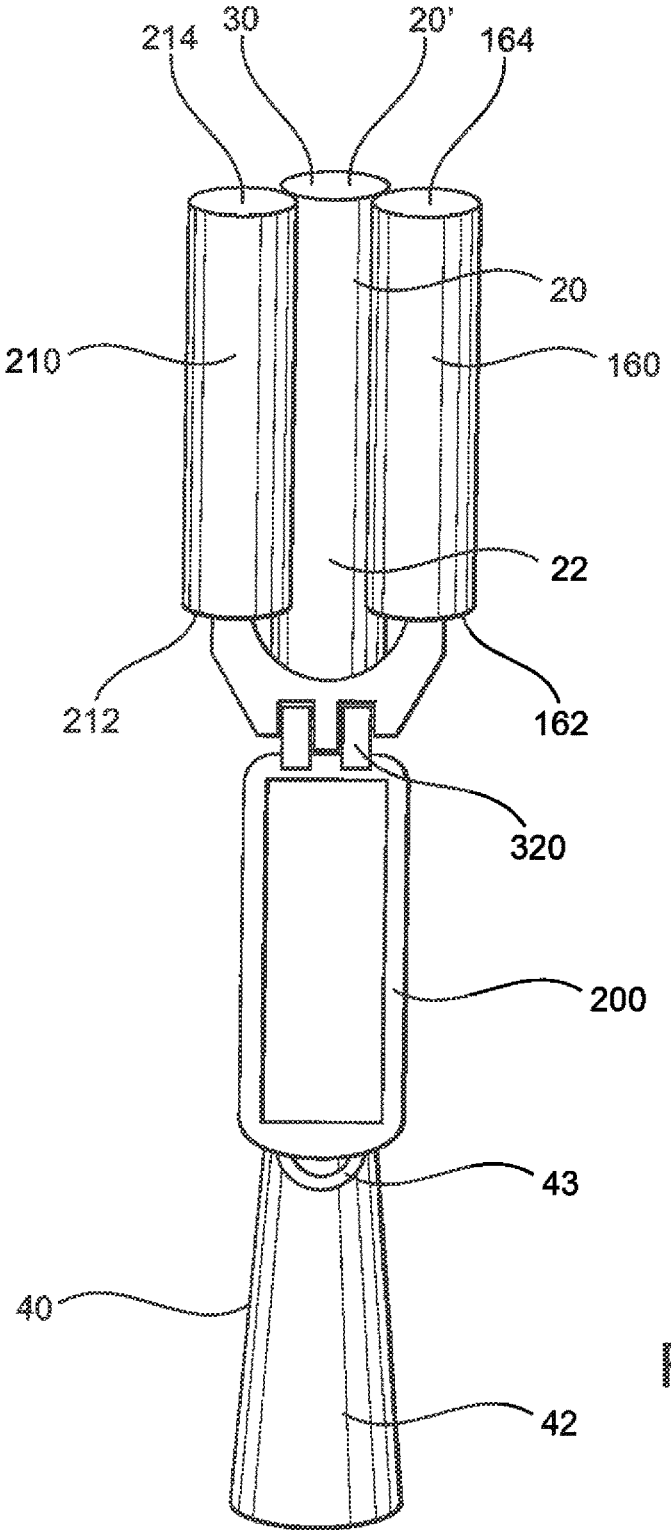
FIG. 8 is a perspective view of the inventive device illustrating the central housing with a connecting member structured to receive and removably secure the mirror attachment to the central housing according to one of the preferred embodiments.

Furthermore, in one of the preferred embodiments as shown in FIG. 8, the mirror attachment 200 is detachable. The detachment allows the user to remove the mirror attachment 200, if and when not desired. As such, the mirror attachment 200 can be detached from its connection to the central housing 20, and reattached when desired. To further characterize this, the central housing 20 has a connecting member 320 structured to receive and removably secure the mirror attachment 200 to the central housing 20. Accordingly, the mirror attachment 200 can be connected to the central housing 20 in a snap fit, press-fit or other similar type of joint fit connections that allow the user to attach and detach the mirror attachment 200 from the central housing 20, as and when preferred.

Figure 9:
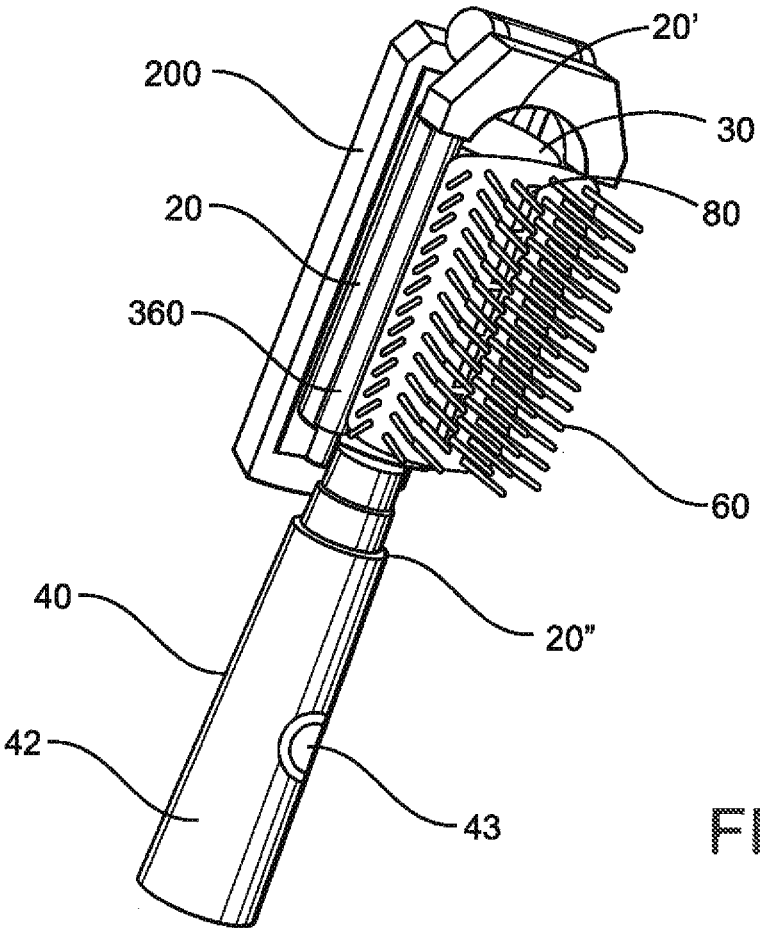
FIG. 9 is a perspective view of the inventive device illustrating one housing with at least two connecting members structured to receive the mirror attachment, sufficient to removably secure the mirror attachment to the inventive device according to one of the preferred embodiments.
Figure 10:
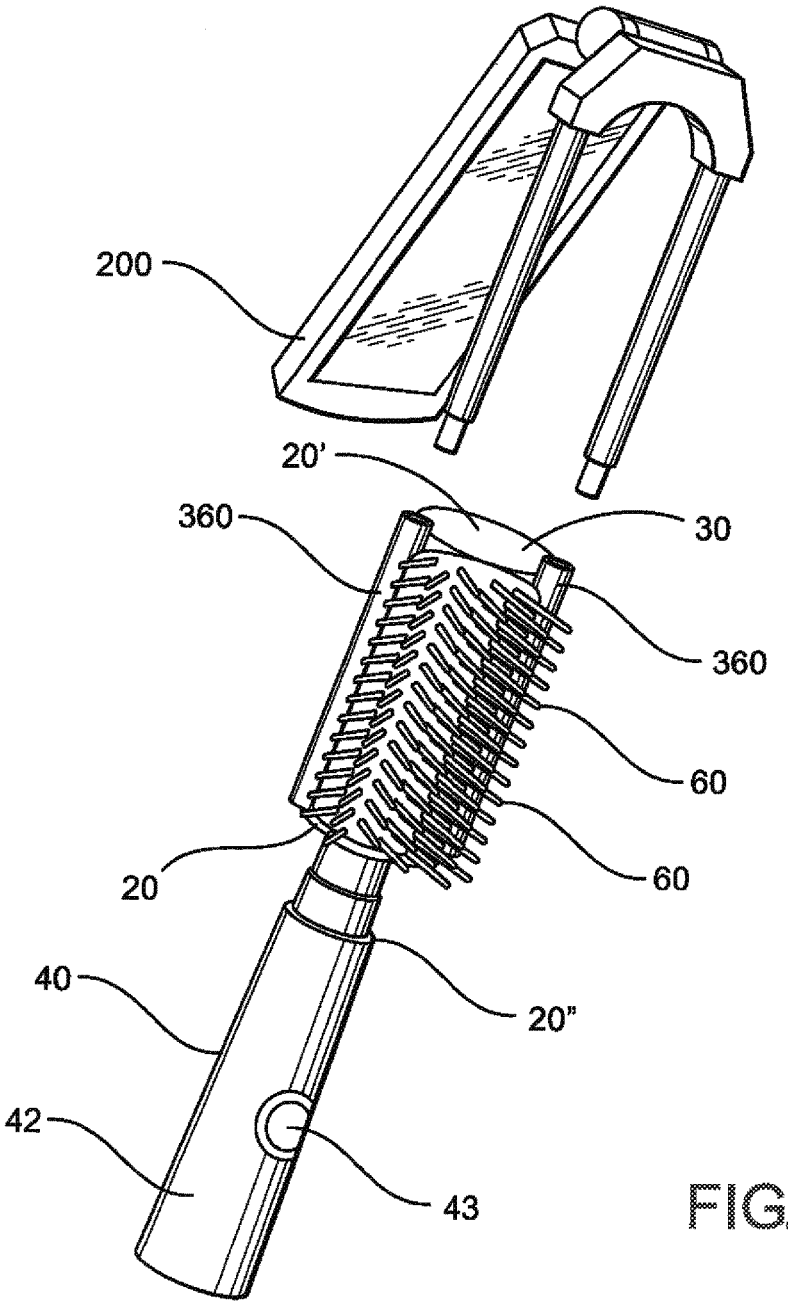
FIG. 10 is an exploded view of the inventive device illustrating the mirror attachment detaching from the connecting members according to one of the preferred embodiments.

Comparatively, in one of the other preferred embodiments with one housing 20 as shown in FIGS. 9 and 10, the housing 20 has at least two connecting members 360. As such, each of the two connecting members 360 are structured to receive at least a portion of the mirror attachment 200, sufficient to removably secure the mirror attachment 200 to the inventive device 10. Alternatively, in one of the embodiments, the mirror attachment 200 can also be permanently affixed to the housing so as to avoid any detachment.

Figure 13:
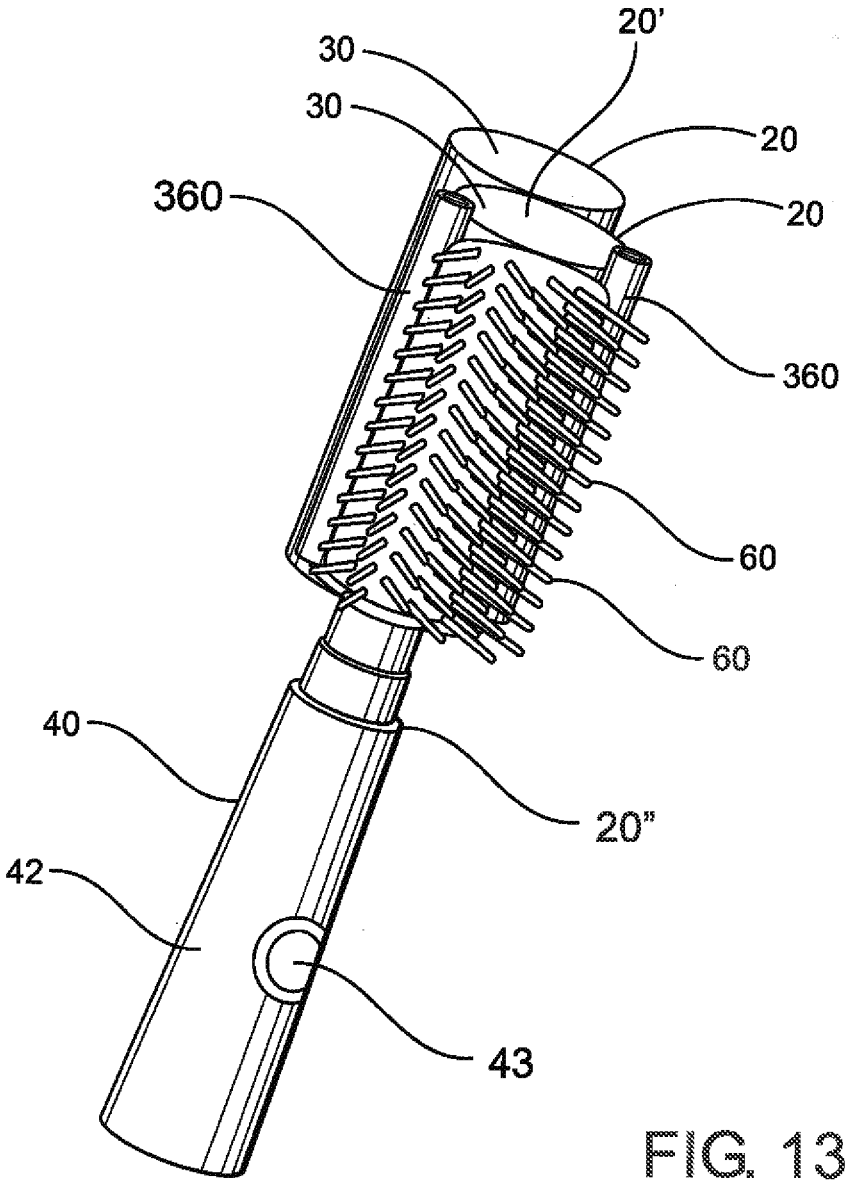
FIG. 13 is a perspective view of the inventive device illustrating two housings with the base removably attached to at least one of the two housings according to one of the preferred embodiments.

Looking further, in one of the other preferred embodiments as shown primarily in FIG. 13, the inventive device 10 may include no more than two housings 20. Each of the two housings 20 are structurally and functionally identical to the ones described in earlier embodiments. Accordingly, one of the two housings 20 has the plurality of bristles 60 attached thereto. Additionally, given this embodiment, it will be appreciated by those skilled in the art that at least one cartridge or cartridge assembly 120 inserted in one of the two housings 20, contains the hair building material in the gel-like form, while at least one cartridge or cartridge assembly 120 inserted in the other of the two housings 20, contains the hair building material in the form of, but not limited to dry powder, fiber-like strands and/or structural combination of both. As such, the processing, blending and dispensing of the hair building materials in this preferred embodiment of the two housings 20 works substantially identical to the aforementioned preferred embodiments. Additionally, in this preferred embodiment and as shown in FIG. 12, the base 40 has the movable member 100 mounted thereon, and the base 40 is removably connected to one of the two housings 20. As a result, similar to the operational features described in one of the preferred embodiments earlier, the hair building material contained in one of the cartridges 120 inserted in one of the two housings 20 is penetrated by the movable member 100, sonically blended by the vibration, and dispensed directly on to the user's hair to blend with the hair building material contained in one of the other cartridges 120 inserted in the other of the two housings 20. As a result, the hair material contained in each of the cartridges 120 in each of the two housings 20 collectively may dispense on the user's hair, when the inventive device 10 is in operative use.

Looking even further and as illustrated in FIGS. 9 and 10, the inventor herein also contemplates that the inventive device 10 may include only one housing 20. In this additional preferred alternative embodiment, as shown in FIG.

12, the inventive device 10 comprises a base 40 with a movable member 100 and the housing 20 with plurality of bristles 60 connected thereto. As such, the user connects the housing 20 with the bristles to the base 40, which has the movable member 100 mounted thereon. To illustrate this further, as the user attaches the housing 20 to the base 40, the movable member 100 mounted on the base 40 is structurally received within an inner cavity of the housing 20. As such, the inner cavity of the housing 20 is sized, structured and configured to receive the movable member 100 so as to ensure a secure fit. Similarly, as in earlier preferred embodiments, the movable member 100 is structured to vibrate and/or oscillate at a frequency that allows the entire inventive device 10 to vibrate as well. As such, the movable member 100 is connected to a power supply that ensures its vibration when actuated. Additionally and not shown in any particular Figure exclusively, the user frictionally attaches the cartridge or cartridge assembly 120 containing the hair building materials in the housing 20 from the open end 20'. As such, even in this additional alternative embodiment as in others previously illustrated, the movable member 100 will preferably vibrate so as to cause the plurality of bristles 60 to also vibrate as the user applies the hair building material on his or her hair. As a result, and similar to the operational features mentioned in embodiments earlier, the hair building material contained in the cartridge 120 inserted into the housing 20 is penetrated by the movable member 100, sonically blended by the vibration, and dispensed directly on to the user's hair as one complete blend of the hair building material containing all the ingredients necessary to promote hair building attributes on the user's scalp. Therefore, it may be appreciated by a person skilled in the art that the hair material contained in the cartridge 120 within the housing 20 will be blended within the cartridge 120 as a complete solution, before it can be dispensed collectively as hair building material comprising of all the ingredients necessary to promote hair building attributes onto the user's scalp/hair, when the inventive device 10 is in operative use.

Figure 15:
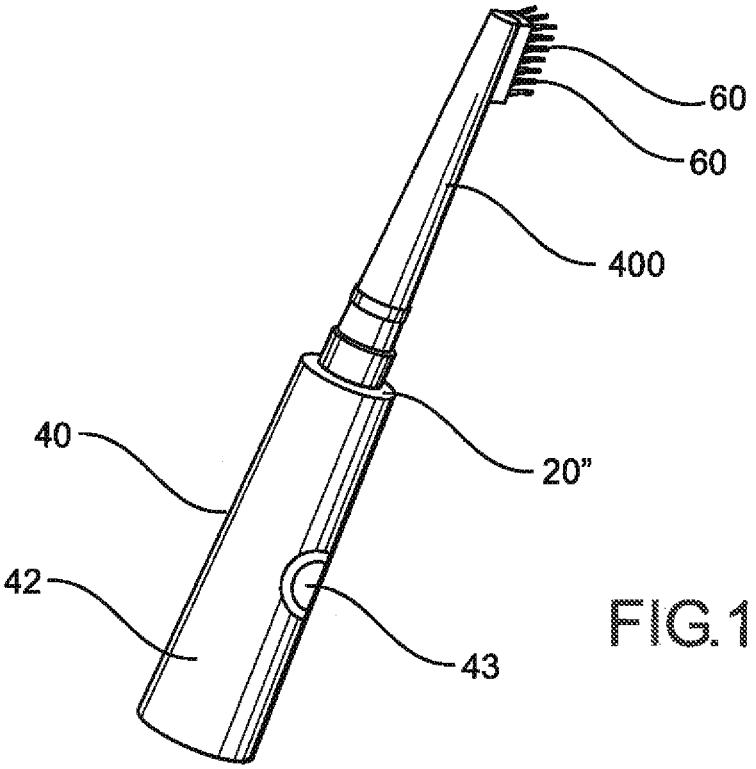
FIG. 15 is a perspective view of the inventive device illustrating the base removably attached to the bristle holder including the plurality of bristles attached thereto according to one of the preferred embodiments.

Looking further in one of the other preferred embodiments and as shown primarily in FIG. 15, the inventive device 10 has the base 40 connected to a bristle holder 400 with the plurality of bristles 60 attached thereto. However, in this preferred embodiment, the inventive device 10 does not include any housings 20. As such, the user securely connects bristle holder 400, to the base 40, which has the movable member 100 mounted on thereto. To illustrate this further, as the user attaches the bristle holder 400 on to the base 40, the movable member 100 mounted on the base 40 is structurally received within an inner cavity of the bristle holder 400. As such, the inner cavity of the bristle holder 400 is sized, structured and configured to receive the movable member 100 so as to ensure a secure fit. Similarly, as in earlier preferred embodiments, the movable member 100 is structured to vibrate and/or oscillate at a frequency that allows the entire inventive device 10 to vibrate as well. As such, the movable member 100 is connected to a power supply that ensures its vibration when actuated. To further illustrate the operational features in this embodiment, the user simply dips the plurality of bristles 60 in each of the hair building material contained in an external container and applies it directly on the scalp and/or hair. However, it is equally important to note that in this preferred embodiment, the movable member 100 vibrates so as to ensure that the plurality of bristles 60 vibrate, as the user applies the hair building material on the hair and/or scalp.

With primary reference now to FIG. 7, in yet another and alternative embodiment, the device 10 of the present invention can comprise a compression member. It will be noted that in this embodiment, the first housing 20 is absent the inclusion of the movable member 100. Instead, the compression member may be connected to the first housing 20 within the hollow interior 30 and possibly in coaxial alignment therewith. Furthermore, the compression member is sized, structured and configured to connect a selected cartridge disposed therein, including the first cartridge 120 and the second cartridge assembly 170. As represented in FIGS. 6 and 7 and as used, a user inserts a selected cartridge, such as the second cartridge assembly 170 containing a portion of the hair building material. The second cartridge assembly 170 is securely connected to the compression member with a predetermined amount of force by the user, sufficient to allow the second cartridge assembly 170 to connect, secure, and remain affixed therein. As a result, the pressure exerted in connecting the second cartridge assembly 170 to the compression member causes one or more ingredients of the portion of the hair building material contained in a corresponding one of the supplies or cartridges of hair building material to flow out of and through a corresponding access opening, through and along the flow path comprising the plurality of pathways 80 in the first housing 20, as is perhaps best shown in FIG. 9, and onto the plurality of bristle elements 60.

Additionally, in one embodiment of the device 10 of the present invention, as illustrated in FIG. 3, the first cartridge assembly 120 or the second cartridge assembly 170 can be connected to a sleeve member 240 having a sleeve cap 240'. The sleeve member 240 is sized, structured and configured to secure at least a portion of a different one of each of the cartridge assemblies 120, 170, etc. As such and by way of example, the sleeve member 240 and the second cartridge assembly 170 are secured to each other, sufficient to ensure that the access opening 172 remains exposed to allow one or more ingredients of the hair building material contained in the second cartridge assembly 170 to flow out freely. Therefore, as an illustration and as shown in FIG. 3, the second cartridge assembly is 170 is securely connected with the sleeve member 240. Then, as shown in FIG. 4, the second cartridge 170 is inserted into the second housing 160 and/or the third housing 210 of the inventive device 10. The sleeve member 240 and the sleeve cap 240' can aid the user to rotationally align the second assembly cartridge 170 when disposed into one of the housings 160, 210, by manipulation of an exteriorly accessible Or member 240'. Alternatively, however, the second cartridge assembly 170 can be free of any connections, like the sleeve member 240, and inserted and/or rotated into alignment with the plurality of pathways as such.

Furthermore, it will be appreciated by those skilled in the art that in one of the preferred embodiments, the inventive device 10 includes detachable arrangements. Accordingly, the mirror attachment 200 is removably attached to at least one housing 20 having the plurality of bristles 60 attached thereto as shown in FIG. 9. Given this, in the preferred embodiment, the mirror attachment 200 and the housing 20 with the plurality of bristles 60 can be collectively detached from the base 40 as shown in FIG. 10. For instance, while attaching the base 40 to the housing 20, the user may execute a counter-clockwise rotation of the base 40 relative to its connection to the housing 20. The counter-clockwise rotation allows the base 40 to engage to the housing 20, and attach itself thereof. More particularly, as shown in FIG. 12, as the base 40 is secured to the housing 20, the movable member 100 mounted on the base 40 is substantially received within the hollow interior chamber 30 of the housing 20 so as to ensure a secure fit. Additionally, in this preferred embodiment, the housing 20 has an open end 20' and a second open end 20''' as shown in FIG. 11. However, when the base 40 is secured to the housing 20, the second open end closes to form a closed end 20'' as shown in FIGS. 9 and 10.

Comparatively, when detaching the base 40 from the housing 20, the base 40 may be rotated in a clockwise direction relative to the housing 20. The clockwise rotation allows the base 40 to disengage from the housing 20, and detach thereof. More particularly, as the base 40 is detached from the housing 20, the movable member 100 mounted on the base is released from its secure fit in the hollow interior chamber 30 of the housing 40 as shown in FIG. 11. Additionally, the closed end 20'' of the housing 20 is re-opened into the second open end 20'''. To further illustrate this preferred embodiment in a detailed manner, the base 40 is secured to the housing 20 during attachment by a retention member disposed on the movable member 100. As a result, when the base 40 is rotated in the counter-clockwise direction relative to the housing 20 and inserted therein, the retention member disposed on the movable member 100 and positioned inside the housing 20, secures the base 40 to the housing 20, sufficient to illustrate the inventive device 10 as a one piece construction. Alternatively, as the base 40 is turned in the clockwise direction relative to the housing 20, the retention member unlocks and releases the base 40 from the housing 20, sufficient to illustrate the inventive device 10 as a two piece construction, one being the base 40 and the other being the combination of the mirror attachment 200, the housing 40 and the plurality of bristles 60 attached thereto.

Figure 14:
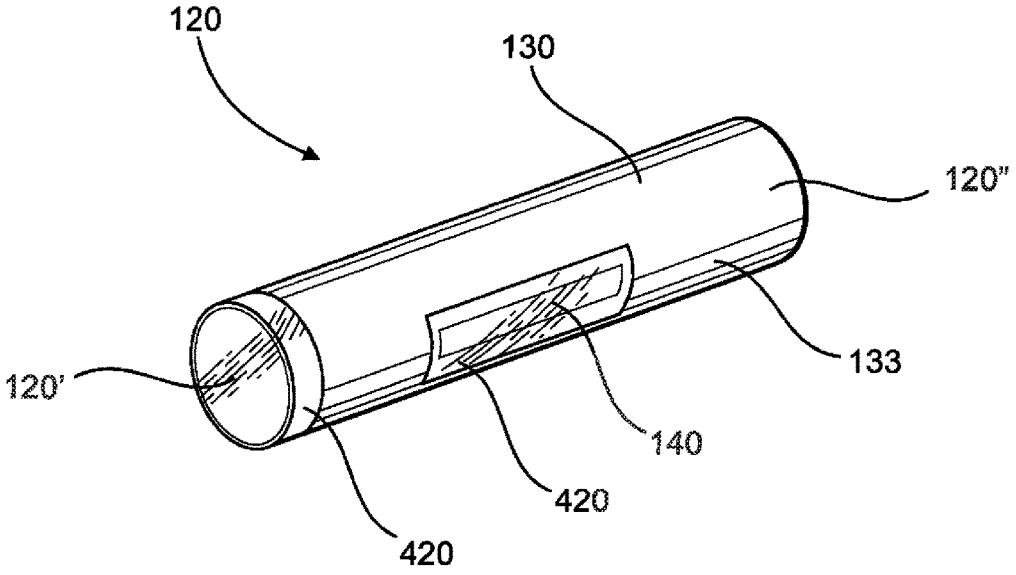
FIG. 14 is a perspective view of the inventive device illustrating the cartridge with an open and closed end, and a sealing member disposed to seal the open end and the access opening of the cartridge according to one of the preferred embodiments.

Furthermore, in one of the preferred embodiments of the inventive device 10, the cartridge or cartridge assembly 120 may not necessitate a penetrable closed end 120''. As such shown primarily in FIG. 14, the cartridge 120 may have a closed end 120'' and an open end 120' that is sealed with a sealing member 420 before the cartridge or cartridge assembly 120 is operationally put to use. To further illustrate this, the user may peel off or remove the sealing member 420 as the cartridge 120 is ready to be inserted within the housing. Similarly, in the relevant embodiments, the access opening, slit or incision 140 on the cartridge 120 assembly may also be sealed with the sealing member 420. To further illustrate this, the user can peel or remove the sealing member 420 off the access opening, slit, or incision 140 of the cartridge assembly 120 as it is ready to be inserted into the housing 20. Alternatively, in one of the preferred embodiments, the user may simply peel off the sealing member 420 on the access opening 140, but retain the sealing member on the open end 120'. As such in this embodiment, the movable member 100 may initiate contact and penetrate the sealing member 420 on the open end 120' when the cartridge 120 is inserted into the hollow interior chamber 30 of the housing 20, and thus, ensure its exposure with the hair building material contained therein.

As set forth above, the present invention may also include an inventive composition or formulation for the aforementioned hair building material usable with the device 10 of the present invention. As such, different portions of the hair building material may be disposed in the different first, second and third cartridges for concurrent delivery from the cartridges to the area of the plurality of bristles 60 where the different portions of the hair building material are substantially blended together.

The preferred and unique composition of the hair building material as used in the inventive device 10 comprises at least a first portion in the form of the aforementioned gel-like material, which may also contain a plurality of bio-active polymeric materials. The gel-like material may contain organic lignin polymers and polysaccharide chains, but is not limited to, Aloe *Ferox* and Aloe Barbadensis Leaf along with Cellulose and Keratin protein fiber. The Cellulose and Keratin protein fiber can help in the formation of the bio-active polymeric structure, which facilitates the binding together of at least some portions of the ingredients of the hair building material. In this regard, the gel-like material is preferably contained in the first cartridge assembly 120. As such, the first cartridge containing the gel-like material is also preferably inserted in the central housing 20 and subject to the vibratory force from movable member 100, as set forth above.

In addition, one or more ingredients of the hair building material can also contain other secondary ingredients such as water, glycerin, carbomer, polysorbate 20, PVP, Aminomethyl Propanol, Methylparaben, Fragrance, Glyceryl, Polymethacrylate, Rahnella and Soy Protein Ferment, Propylene Glycol, Peg 8, Palmitoyl, Tripeptide-1, Keratin Amino Acids, Panthenyl Ethyl, Ether, Diazolidinyl, Urea, Potassium Sorbate, Tetrasodium EDTA, Methylchloroisothiazolinone, Methylsothiazolinone, and Benzophenone-4 Blue 1 and Violet 2.

Furthermore, the hair building material can utilize 150-200 minerals, enzymes, vitamins, and amino acids to promote hair building characteristics. As such, the secondary ingredients may not be limited to any particular known combination of polymeric materials known in the industry. Given this, the hair building material can be processed in combination with all the necessary ingredients for the desired bonding effect onto the hair and the hair scalp. Accordingly, some portion of the secondary ingredients of the hair building material are contained in the second cartridge assembly 170 collectively and/or individually. In this regard, the hair building material in the second cartridge assembly 170 can be formed of a dry powder blend comprising some portions of the hair building ingredients. Likewise, the second cartridge assembly 170 and/or a third cartridge 210 can also contain the hair building material in the form of fibers that resemble hair like strands and/or fiber segments comprising one or more ingredients of the hair building material.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A dispensing device for treating hair with a hair building material, said device comprising:

a first housing having a first open end, a second end opposite said first open end, a body extending between said first open end and said second end, and having a hollow interior continuous with said first open end and said second end, and a plurality of bristle elements protruding from an exterior surface of said body;

said first housing having a plurality of openings in said body allowing for fluid flow communication between said first housing and said plurality of bristle elements;

a first cartridge structured and dimensioned to be operatively disposed within said hollow interior of said first housing, said first cartridge including a sealed open end and a closed end, and further including at least one opening extending through a side thereof in fluid communication with said plurality of openings of said first housing, said first cartridge containing at least a first supply of hair building material;

a second housing having a first closed end, a second open end opposite said first closed end, an outer wall defining a hollow interior between said first closed end and said second open end, and said outer wall including a plurality of access openings allowing for fluid flow communication between said second housing and said plurality of bristle elements;

said second housing coupled to said first housing and extending adjacent and in substantially parallel relation to said first housing;

a sleeve member removably connected to said hollow interior of said second housing, said sleeve member including opposing ends and an elongated side extending between said opposing ends, and said sleeve member further including at least one opening extending through said elongated side to allow fluid flow communication between said second housing, said sleeve member and said plurality of bristle elements;

a second cartridge structured and dimensioned to be operatively disposed within said sleeve member, said second cartridge having at least one opening extending through a side thereof and in fluid flow communication with said at least one opening of said sleeve member and said second housing;

said second cartridge containing a second supply of hair building material;

said first cartridge and said sleeve member including said second cartridge structured for substantially concurrent delivery of said first and second supplies of hair building material through their respective openings and for at least partial blending of said first and second supplies of hair building material at said plurality of bristle elements, a base having a first proximal end and a second oppositely disposed distal end, said second distal end of said base being removably connected to said first housing, and said first proximal end of said base providing a gripping surface for grasping by a user; and said base further comprising a vibrating member extending axially from said second distal end thereof and disposed within said first housing and said first cartridge assembly, said vibrating member operable to penetrate said seal of said first cartridge, and to make contact with at least said first supply of hair building material by a coupling of said base with said first housing.

2. The dispensing device as recited in claim 1, wherein said first cartridge and said sleeve member are each independently and removably disposed within said first housing and said second housing, respectively.

3. The dispensing device as recited in claim 2, wherein at least one of said first cartridge and said sleeve member is exteriorly accessible and structured for rotational movement within its respective housing, so as to vary an orientation of said respective access openings.

4. The dispensing device as recited in claim 1, wherein said at least one opening in said first cartridge is aligned with a first portion of said plurality of bristle elements and said at least one opening in said sleeve member is aligned with a second and oppositely disposed portion of said plurality of bristle elements.

5. The dispensing device as recited in claim 4, wherein said at least one opening of said first cartridge and said at least one opening of said sleeve member define at least two flow paths structured to concurrently deliver both said first supply of hair building material and said second supply of hair building material to said plurality of bristle elements in spaced apart relation and facilitate blending thereof during brushing contact with the hair.

6. The dispensing device as recited in claim 1, wherein said vibrating member is structured to exert a vibrating force on at least one of said first cartridge and said sleeve member and the hair building material contained therein.

7. The dispensing device as recited in claim 6, wherein said vibrating force is sufficient to alter an original viscosity of the hair building material.

8. The dispensing device as recited in claim 7, wherein said vibrating force is sufficient to at least partially liquefy the hair building material within said cartridge.

9. The dispensing device as recited in claim 6, further comprising a drive structure mounted on said base and connected in driving relation to at least said vibrating member.

10. The dispensing device as recited in claim 9, wherein said drive structure is disposed and structured to exert a vibrating force on said plurality of bristle elements, said plurality of bristle elements being movable relative to one another and the hair building material disposed thereon.

11. The dispensing device as recited in claim 9, wherein said drive structure is disposed in at least partially driving relation to said first housing and said second housing and corresponding ones of said first and second supplies of hair building material disposed therein.

12. The dispensing device as recited in claim 1, further comprising at least three housings each structured to removably retain a different one of a plurality of cartridges, each containing a supply of the hair building material therein.

13. The dispensing device as recited in claim 12, wherein at least two of said housings are dimensioned and configured to each receive one of a plurality of commonly dimensioned cartridges therein.

14. The dispensing device as recited in claim 1, further comprising a mirror assembly movably connected to said base and disposable between an open, exposed position and a closed, concealed position.

15. The dispensing device as recited in claim 1, wherein said first supply of hair building material is a wet hair building material.

16. The dispensing device as recited in claim 15, wherein said second supply of hair building material is a dry hair building material.

* * * * *